US009527319B1

(12) United States Patent
Brazas, Jr. et al.

(10) Patent No.: US 9,527,319 B1
(45) Date of Patent: Dec. 27, 2016

(54) PRINTHEAD ASSEMBLY WITH REMOVABLE JETTING MODULE

(71) Applicant: Eastman Kodak Company, Rochester, NY (US)

(72) Inventors: John Charles Brazas, Jr., Hilton, NY (US); Charles D. Rike, Lebanon, OH (US); Michael J. Piatt, Dayton, OH (US); Scott F. Roberts, New Carlisle, OH (US); David F. Tunmore, Xenia, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/163,243

(22) Filed: May 24, 2016

(51) Int. Cl.
*B41J 25/00* (2006.01)
*B41J 2/01* (2006.01)

(52) U.S. Cl.
CPC ..... *B41J 25/001* (2013.01); *B41J 2/01* (2013.01)

(58) Field of Classification Search
CPC ..... B41J 25/001; B41J 25/003; B41J 25/005; B41J 25/006; B41J 1/28; B41J 2/1752; B41J 15/10; B41J 15/12
See application file for complete search history.

(56) References Cited

U.S. PATENT DOCUMENTS 6,247,781 B1 6/2001 Blum
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
6,910,756 B2 6/2005 Blum et al.
7,819,501 B2 10/2010 Hanchak et al.
7,871,145 B1 1/2011 Enge
8,226,215 B2 7/2012 Bechler et al.
(Continued)

FOREIGN PATENT DOCUMENTS

EP 805 031 1/2000

*Primary Examiner* — Matthew Luu
*Assistant Examiner* — Patrick King
(74) *Attorney, Agent, or Firm* — Kevin E. Spaulding

(57) ABSTRACT

An inkjet printhead assembly includes a rail assembly and a removable jetting module. The rail assembly includes a beam and a rod attached to the beam. A printhead module includes the jetting module and a mounting assembly. The jetting module includes an array of nozzles, a first alignment tab having a first alignment datum and a second alignment datum, a second alignment tab having a third alignment datum and a fourth alignment datum, a rotational alignment feature including a fifth alignment datum, and a cross-track alignment feature including a sixth alignment datum. The mounting assembly includes a similar set of alignment features. Portions of the alignment tabs of the jetting module and the mounting assembly are adapted to fit within corresponding notches in the beam and engage with the rod. A jetting module clamping mechanism applies a force to the jetting module causing it to engage with the rail assembly.

16 Claims, 21 Drawing Sheets

(56) References Cited

U.S. PATENT DOCUMENTS 8,235,501 B2 * 8/2012 Oguchi ..... B41J 2/155 347/108
8,469,496 B2 6/2013 Panchawagh et al.
8,585,189 B1 11/2013 Marcus et al.
8,641,175 B2 2/2014 Panchawagh et al.
8,651,632 B2 2/2014 Marcus et al.
8,651,633 B2 2/2014 Marcus et al.
8,657,419 B2 2/2014 Panchawagh et al.
8,696,094 B2 4/2014 Marcus et al.
8,888,256 B2 11/2014 Marcus et al.
9,259,916 B1 2/2016 Piatt et al.
2005/0156963 A1 * 7/2005 Song ..... B41J 2/04505 347/9
2005/0206678 A1 * 9/2005 Nishino ..... B41J 2/21 347/43
2009/0295878 A1 * 12/2009 Hanchak ..... B41J 2/02 347/74
2010/0245415 A1 * 9/2010 Tsai ..... B41J 25/34 347/8
2010/0295896 A1 * 11/2010 Albertalli ..... B41J 2/2135 347/37
2011/0128323 A1 * 6/2011 Saito ..... B41J 2/155 347/40
2011/0181662 A1 * 7/2011 Izawa ..... B41J 2/155 347/42
2011/0199434 A1 * 8/2011 Bechler ..... B41J 2/03 347/49
2011/0314650 A1 * 12/2011 Fishkin ..... B41J 2/03 29/281.5
2011/0316933 A1 * 12/2011 Fishkin ..... B41J 2/02 347/49
2012/0306960 A1 * 12/2012 Niihara ..... B41J 2/1752 347/20
2014/0168319 A1 * 6/2014 Moreau ..... B41J 2/145 347/49
2014/0259595 A1 * 9/2014 Von Essen ..... B41J 29/00 29/407.1

* cited by examiner

PRINTHEAD ASSEMBLY WITH REMOVABLE JETTING MODULE

CROSS-REFERENCE TO RELATED APPLICATIONS

Reference is made to commonly assigned, co-pending U.S. patent application Ser. No. 15/163,235, entitled: "Modular printhead assembly with common center rail", by J. Brazas et al.; and to commonly assigned, co-pending U.S. patent application Ser. No. 15/163,549, entitled: "Inkjet printhead assembly with repositionable shutter", by J. Brans et al., each which is incorporated herein by reference.

FIELD OF THE INVENTION

This invention pertains to the field of inkjet printing and more particularly to an inkjet printhead assembly including a removable jetting module.

BACKGROUND OF THE INVENTION

In the field of high speed inkjet printing it is desirable to be able to print across the width of the print media in a single pass of the print media past a print station. However, for many applications the desired print width exceeds the width of the available printheads. It is therefore necessary to arrange an array of printheads such that each printhead in the array prints a print swath, and the set of print swaths cover the entire print width. Whenever the printed image is made of a set of print swaths, it is necessary to align or stitch each pair of adjacent print swaths to each other such that the seam between adjacent print swaths is not visible.

For such printing applications it is desirable to provide some means to accurately align the array of printheads relative to each other to provide consistency in the stitching of the print swaths. Even with improvements in the reliability of the printheads, it is desirable to provide means for removing and replacing individual printheads within the array of printheads. The structure for aligning the printheads into an array should therefore enable individual printheads to be removed from the array and replaced with another printhead with minimal change in the alignment of the printheads and their corresponding print swaths.

Commonly assigned U.S. Pat. No. 8,226,215 (Bechler et al.) provides a structure for aligning a plurality of printheads, with the printheads arranged in two staggered rows of printheads. It uses a printhead baseplate that includes sets of kinematic alignment features, one set for each printhead, to engage with alignment features on the printheads in order to provide repeatable alignment of the printheads.

Even with a fixed alignment of the array of printheads there is some variation in the quality of the stitching. It has been determined that the amplitude of the stitching variation depends in part on the spacing between the nozzle arrays in the two rows of printheads, with a smaller spacing between the rows yielding less variation in the stitching. It has also been found that as the desired print width increases, the cost for manufacturing the alignment baseplate to accommodate the increased print width increases significantly. There remains a need to provide an improved alignment system that can more readily accommodate wider print widths and provide a reduced spacing between the nozzle arrays in the rows of printheads.

In the field of continuous inkjet printing, each printhead includes a drop generator, which includes an array of nozzles, and drop selection hardware, which includes a mechanism to cause, for each of the nozzles in the array, the trajectories of printing drops to diverge from the trajectories of non-printing drops. An ink catcher is used to intercept the trajectory of the non-printing drops from each nozzle. It has been found that a skew of the drop selection hardware relative to the nozzle array can contribute to a skew of the images printed by the printhead relative to the print swaths of other printheads in an array of printheads. There remains a need for an improved system for aligning the drop selection hardware of a printhead relative to the nozzle array of a printhead.

In the field of continuous inkjet printing, it has been common to provide a shutter mechanism for sealing an outlet of the printheads to prevent ink from passing through the outlet during startup/shutdown and other maintenance procedures of the printhead. The shutter is then displaced from the outlet during the operation mode of the printhead to enable print drops to be emitted through the outlet and deposited onto the print media. Prior art shutter arrangements have been found to limit the spacing between printhead rows, and to limit the effectiveness for performing various maintenance operations. There remains a need for a compact repositionable shutter mechanism.

SUMMARY OF THE INVENTION

The present invention represents an inkjet printhead assembly including a removable jetting module for printing on a print medium traveling along a media path from upstream to downstream, including:

- a rail assembly spanning the print medium in the cross-track direction including:
  - a beam; and
  - a rod attached to a side of the beam that faces the print medium;
- a printhead module including:
  - a jetting module having an array of nozzles extending in a cross-track direction, wherein the jetting module includes:
    - a first alignment tab having a first alignment datum and a second alignment datum;
    - a second alignment tab having a third alignment datum and a fourth alignment datum, the second alignment tab being spaced apart from the first alignment tab in the cross-track direction;
    - a rotational alignment feature including a fifth alignment datum; and
    - a cross-track alignment feature including a sixth alignment datum; and
  - a mounting assembly adapted to engage with the rail assembly at a defined cross-track position including:
    - a third alignment tab having a seventh alignment datum and an eighth alignment datum;
    - a fourth alignment tab having a ninth alignment datum and a tenth alignment datum, the fourth alignment tab being spaced apart from the third alignment tab in the cross-track direction;
    - a rotational alignment feature including an eleventh alignment datum;
    - a jetting module clamping mechanism for applying a force to the jetting module that causes the first alignment datum, the second alignment datum, the third alignment datum and the fourth alignment datum of the jetting module to engage with the rod, and causes the fifth alignment datum of the jetting module to engage with corresponding rotational alignment feature associated with the beam; and a mounting assembly clamping mechanism for applying a force to the mounting assembly that causes the seventh alignment datum, the eighth alignment datum, the ninth alignment datum, and the tenth alignment datum of the mounting assembly to engage with the rod, and causes the eleventh alignment datum of the mounting assembly to engage with a corresponding alignment feature on the beam; and a jetting module cross-track force mechanism for applying a cross-track force to the jetting module that causes the sixth alignment datum of the jetting module to engage with a corresponding cross-track alignment feature associated with the beam;

wherein portions of the first and second alignment tabs of the jetting module and portions of the third and fourth alignment tabs of the mounting assembly are adapted to fit within corresponding notches in the beam.

This invention has the advantage that both the jetting module and the mounting assembly can be easily removed and replaced.

It has the further advantage that the printhead assembly is more compact and less expensive to manufacture relative to prior art printhead assemblies.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use printheads to emit liquids (other than inks) that need to be finely metered and deposited with high spatial precision. As such, as described herein, the terms "liquid" and "ink" refer to any material that can be ejected by the printhead or printhead components described below.

Figure 1:
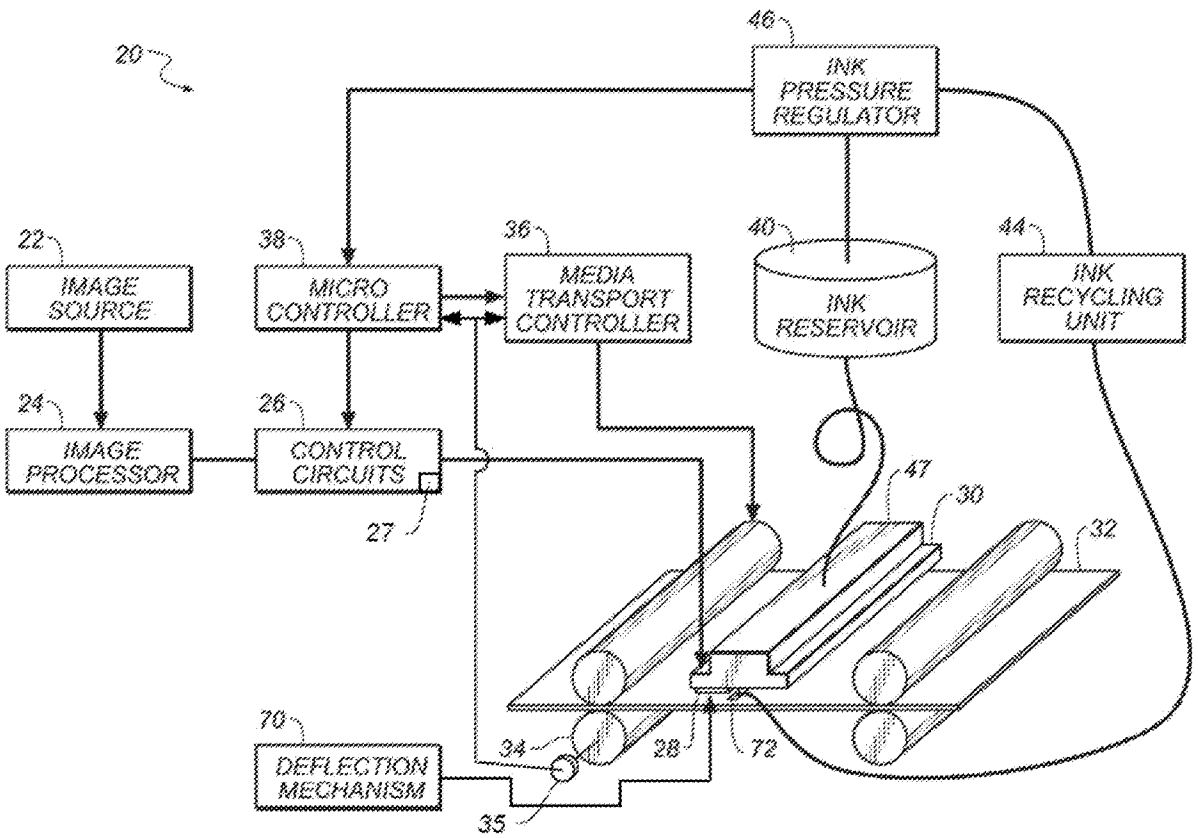
FIG. 1 (Prior Art)
FIG. 1 is a simplified block schematic diagram of an exemplary continuous inkjet system according to the present invention.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit (image processor) 24 which also stores the image data in memory. A plurality of drop forming transducer control circuits 26 reads data from the image memory and apply time-varying electrical pulses to a drop forming transducers 28 that are associated with one or more nozzles of a printhead 30. These pulses are applied at an appropriate time, and to the appropriate nozzles, so that drops formed from a continuous ink jet stream will form spots on a print medium 32 in the appropriate position designated by the data in the image memory.

Print medium 32 is moved relative to the printhead 30 by a print medium transport system 34, which is electronically controlled by a media transport controller 36 in response to signals from a speed measurement device 35. The media transport controller 36 is in turn is controlled by a microcontroller 38. The print medium transport system shown in FIG. 1 is a schematic only, and many different mechanical configurations are possible. For example, a transfer roller could be used in the print medium transport system 34 to facilitate transfer of the ink drops to the print medium 32.

Such transfer roller technology is well known in the art. In the case of page width printheads, it is most convenient to move the print medium 32 along a media path past a stationary printhead. However, in the case of scanning print systems, it is often most convenient to move the printhead along one axis (the sub-scanning direction) and the print medium 32 along an orthogonal axis (the main scanning direction) in a relative raster motion.

Ink is contained in an ink reservoir 40 under pressure. In the non-printing state, continuous ink jet drop streams are unable to reach print medium 32 due to an ink catcher 72 that blocks the stream of drops, and which may allow a portion of the ink to be recycled by an ink recycling unit 44. The ink recycling unit 44 reconditions the ink and feeds it back to the ink reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to the ink reservoir 40 under the control of an ink pressure regulator 46. Alternatively, the ink reservoir can be left unpressurized, or even under a reduced pressure (vacuum), and a pump can be employed to deliver ink from the ink reservoir under pressure to the printhead 30. In such an embodiment, the ink pressure regulator 46 can include an ink pump control system. The ink is distributed to the printhead 30 through an ink channel 47. The ink preferably flows through slots or holes etched through a silicon substrate of printhead 30 to its front surface, where a plurality of nozzles and drop forming transducers, for example, heaters, are situated. When printhead 30 is fabricated from silicon, the drop forming transducer control circuits 26 can be integrated with the printhead 30. The printhead 30 also includes a deflection mechanism 70 which is described in more detail below with reference to FIGS. 2 and 3.

Figure 2:
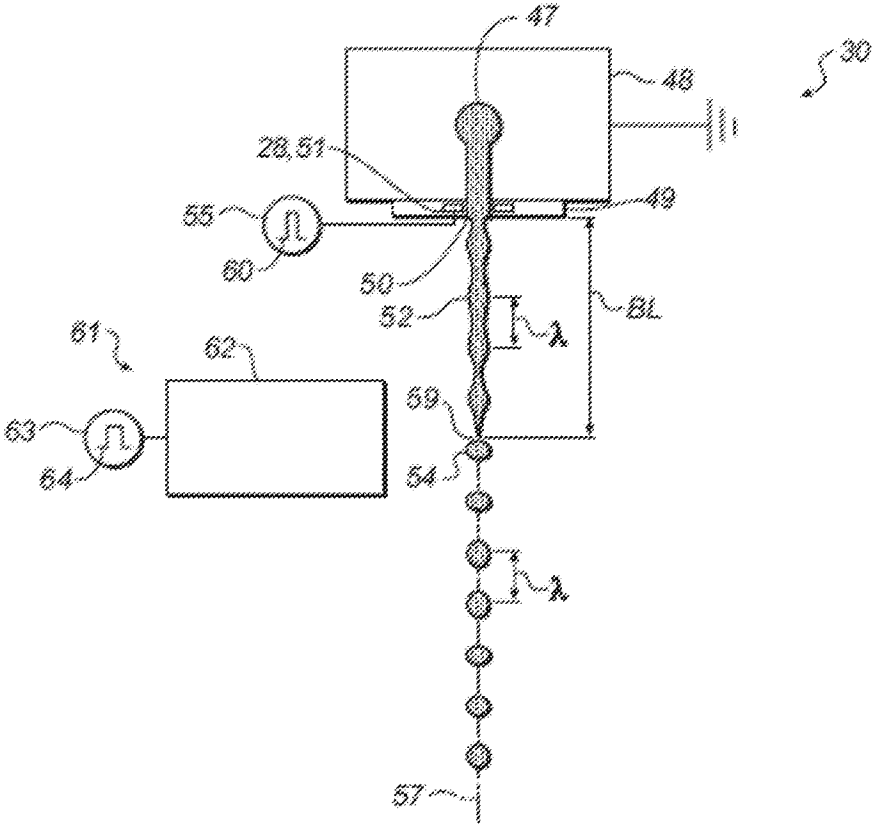
FIG. 2 (Prior Art)
FIG. 2 shows an image of a liquid jet being ejected from a drop generator and its subsequent break off into drops with a regular period.

Referring to FIG. 2, a schematic view of continuous liquid printhead 30 is shown. A jetting module 48 of printhead 30 includes an array of nozzles 50 formed in a nozzle plate 49. In FIG. 2, nozzle plate 49 is affixed to the jetting module 48. Alternatively, the nozzle plate 49 can be integrally formed with the jetting module 48. Liquid, for example, ink, is supplied to the nozzles 50 via liquid channel 47 at a pressure sufficient to form continuous liquid streams 52 (sometimes referred to as filaments) from each nozzle 50. In FIG. 2, the array of nozzles 50 extends into and out of the figure.

Jetting module 48 is operable to cause liquid drops 54 to break off from the liquid stream 52 in response to image data. To accomplish this, jetting module 48 includes a drop stimulation or drop forming transducer 28 (e.g., a heater, a piezoelectric actuator, or an electrohydrodynamic stimulation electrode), that, when selectively activated, perturbs the liquid stream 52, to induce portions of each filament to break off and coalesce to form the drops 54. Depending on the type of transducer used, the transducer can be located in or adjacent to the liquid chamber that supplies the liquid to the nozzles 50 to act on the liquid in the liquid chamber, can be located in or immediately around the nozzles 50 to act on the liquid as it passes through the nozzle, or can be located adjacent to the liquid stream 52 to act on the liquid stream 50 after it has passed through the nozzle 50.

In FIG. 2, drop forming transducer 28 is a heater 51, for example, an asymmetric heater or a ring heater (either segmented or not segmented), located in the nozzle plate 49 on one or both sides of the nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat. No. 6,827,429 (Jeanmaire et al.); and U.S. Pat. No. 6,851,796 (Jeanmaire et al.), each of which is incorporated herein by reference.

Typically, one drop forming transducer 28 is associated with each nozzle 50 of the nozzle array. However, in some configurations, a drop forming transducer 28 can be associated with groups of nozzles 50 or all of the nozzles 50 in the nozzle array.

Referring to FIG. 2 the printing system has associated with it, a printhead 30 that is operable to produce, from an array of nozzles 50, an array of liquid streams 52. A drop forming device is associated with each liquid stream 52. The drop formation device includes a drop forming transducer 28 and a drop formation waveform source 55 that supplies a drop formation waveform 60 to the drop forming transducer 28. The drop formation waveform source 55 is a portion of the mechanism control circuits 26. In some embodiments in which the nozzle plate is fabricated of silicon, the drop formation waveform source 55 is formed at least partially on the nozzle plate 49. The drop formation waveform source 55 supplies a drop formation waveform 60 that typically includes a sequence of pulses having a fundamental frequency $f_O$ and a fundamental period of $T_O=1/f_O$ to the drop formation transducer 28, which produces a modulation with a wavelength $\lambda$, in the liquid jet. The modulation grows in amplitude to cause portions of the liquid stream 52 to break off into drops 54. Through the action of the drop formation device, a sequence of drops 54 is produced. In accordance with the drop formation waveform 60, the drops 54 are formed at the fundamental frequency $f_O$ with a fundamental period of $T_O=1/f_O$. In FIG. 2, liquid stream 52 breaks off into drops with a regular period at break off location 59, which is a distance, called the break off length, BL from the nozzle 50. The distance between a pair of successive drops 54 is essentially equal to the wavelength $\lambda$ of the perturbation on the liquid stream 52. The stream of drops 54 formed from the liquid stream 52 follow an initial trajectory 57.

The break off time of the droplet for a particular printhead can be altered by changing at least one of the amplitude, duty cycle, or number of the stimulation pulses to the respective resistive elements surrounding a respective resistive nozzle orifice. In this way, small variations of either pulse duty cycle or amplitude allow the droplet break off times to be modulated in a predictable fashion within ±one-tenth the droplet generation period.

Also shown in FIG. 2 is a charging device 61 comprising charging electrode 62 and charging electrode waveform source 63. The charging electrode 62 associated with the liquid jet is positioned adjacent to the break off point 59 of the liquid stream 52. If a voltage is applied to the charging electrode 62, electric fields are produced between the charging electrode and the electrically grounded liquid jet, and the capacitive coupling between the two produces a net charge on the end of the electrically conductive liquid stream 52. (The liquid stream 52 is grounded by means of contact with the liquid chamber of the grounded drop generator.) If the end portion of the liquid jet breaks off to form a drop while there is a net charge on the end of the liquid stream 52, the charge of that end portion of the liquid stream 52 is trapped on the newly formed drop 54.

Figure 4:
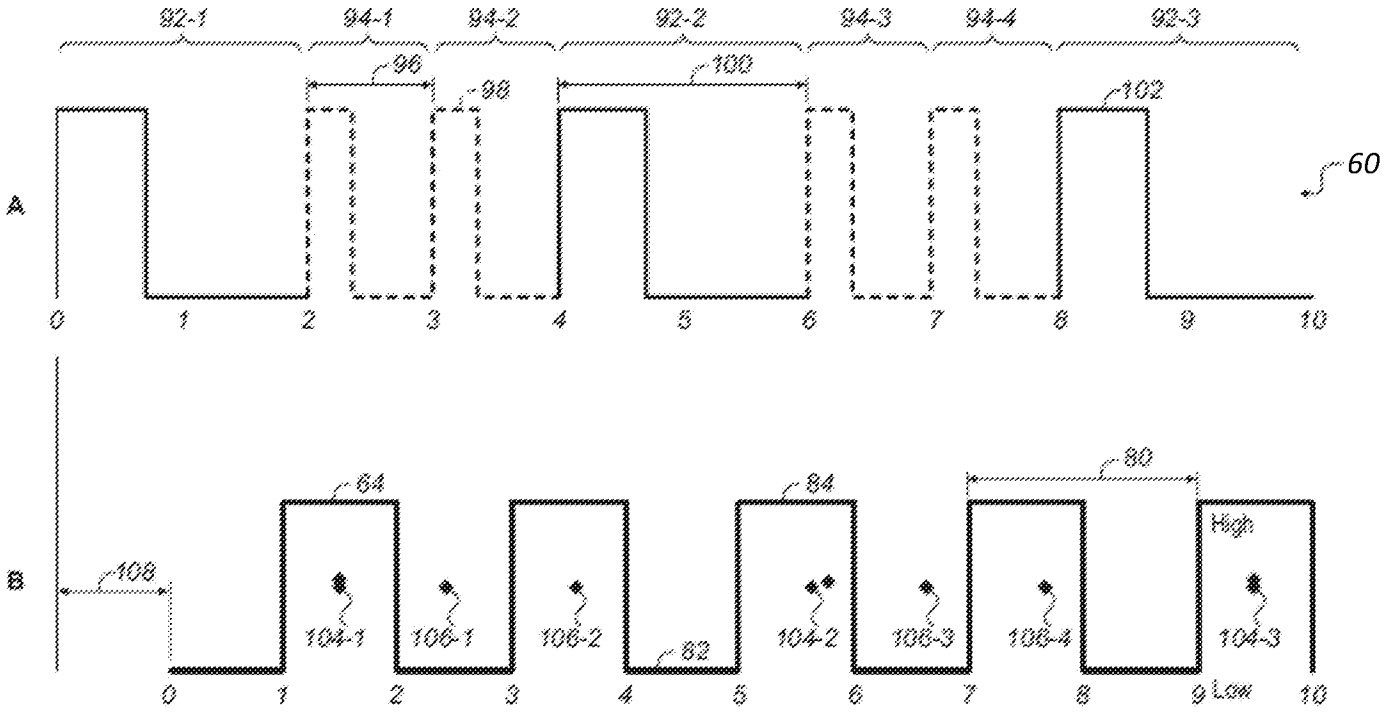
FIG. 4 (Prior Art)
FIG. 4 shows a first example embodiment of a timing diagram illustrating drop formation pulses, the charging electrode waveform, and the break off of drops.

The voltage on the charging electrode 62 is controlled by the charging electrode waveform source 63, which provides a charging electrode waveform 64 operating at a charging electrode waveform 64 period 80 (shown in FIG. 4). The charging electrode waveform source 63 provides a varying electrical potential between the charging electrode 62 and the liquid stream 52. The charging electrode waveform source 63 generates a charging electrode waveform 64, which includes a first voltage state and a second voltage state; the first voltage state being distinct from the second voltage state. An example of a charging electrode waveform is shown in part B of FIG. 4. The two voltages are selected such that the drops 54 breaking off during the first voltage state acquire a first charge state and the drops 54 breaking off during the second voltage state acquire a second charge state. The charging electrode waveform 64 supplied to the charging electrode 62 is independent of, or not responsive to, the image data to be printed. The charging device 61 is synchronized with the drop formation device using a conventional synchronization device 27, which is a portion of the control circuits 26, (see FIG. 1) so that a fixed phase relationship is maintained between the charging electrode waveform 64 produced by the charging electrode waveform source 63 and the clock of the drop formation waveform source 55. As a result, the phase of the break off of drops 54 from the liquid stream 52, produced by the drop formation waveforms 92, 94 (see FIG. 4), is phase locked to the charging electrode waveform 64. As indicated in FIG. 4, there can be a phase shift 108, between the charging electrode waveform 64 and the drop formation waveforms 92, 94.

Figure 3:
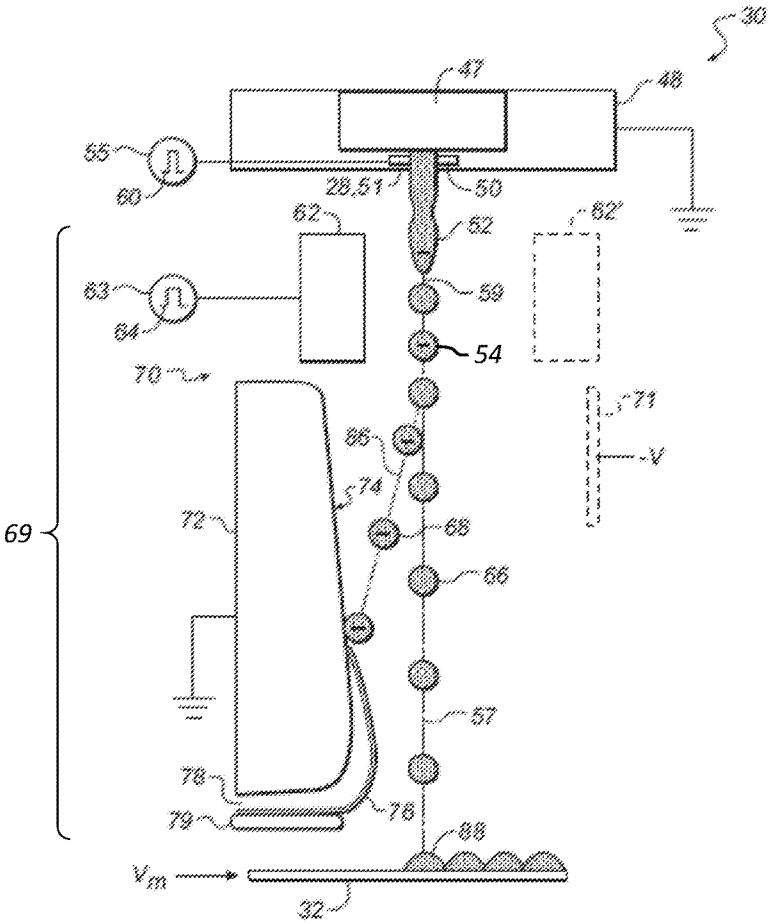
FIG. 3 (Prior Art)
FIG. 3 shows a cross sectional of an inkjet printhead of the continuous liquid ejection system according to this invention.

With reference now to FIG. 3, printhead 30 includes a drop forming transducer 28 which creates a liquid stream 52 that breaks up into ink drops 54. Selection of drops 54 as printing drops 66 or non-printing drops 68 will depend upon the phase of the droplet break off relative to the charging electrode voltage pulses that are applied to the to the charging electrode 62 that is part of the deflection mechanism 70, as will be described below. The charging electrode 62 is variably biased by a charging electrode waveform source 63. The charging electrode waveform source 63 provides charging electrode waveform 64, also called a charging electrode waveform 64, in the form of a sequence of charging pulses. The charging electrode waveform 64 is periodic, having a charging electrode waveform 64 period 80 (FIG. 4).

An embodiment of a charging electrode waveform 64 is shown in part B of FIG. 4. The charging electrode waveform 64 comprises a first voltage state 82 and a second voltage state 84. Drops breaking off during the first voltage state 82 are charged to a first charge state and drops breaking off during the second voltage state 84 are charged to a second charge state. The second voltage state 84 is typically at a high level, biased sufficiently to charge the drops 54 as they break off. The first voltage state 82 is typically at a low level relative to the printhead 30 such that the first charge state is relatively uncharged when compared to the second charge state. An exemplary range of values of the electrical potential difference between the first voltage state 82 and a second voltage state 84 is 50 to 300 volts and more preferably 90 to 150 volts.

Returning to a discussion of FIG. 3, when a relatively high level voltage or electrical potential is applied to the charging electrode 62 and a drop 54 breaks off from the liquid stream 52 in front of the charging electrode 62, the drop 54 acquires a charge and is deflected by deflection mechanism 70 towards the ink catcher 72 as non-pint drops 68. The non-printing drops 68 that strike the catcher face 74 form an ink film 76 on the face of the ink catcher 72. The ink film 76 flows down the catcher face 74 and enters liquid channel 78 (also called an ink channel), through which it flows to the ink recycling unit 44. The liquid channel 78 is typically formed between the body of the catcher 72 and a lower plate 79.

Deflection occurs when drops 54 break off from the liquid stream 52 while the potential of the charging electrode 62 is provided with an appropriate voltage. The drops 54 will then acquire an induced electrical charge that remains upon the droplet surface. The charge on an individual drop 54 has a polarity opposite that of the charging electrode 62 and a magnitude that is dependent upon the magnitude of the voltage and the coupling capacitance between the charging electrode 52 and the drop 54 at the instant the drop 54 separates from the liquid jet. This coupling capacitance is dependent in part on the spacing between the charging electrode 62 and the drop 54 as it is breaking off. It can also be dependent on the vertical position of the breakoff point 59 relative to the center of the charge electrode 62. After the charge drops 54 have broken away from the liquid stream 52, they continue to pass through the electric fields produced by the charge plate. These electric fields provide a force on the charged drops deflecting them toward the charging electrode 62. The charging electrode 62, even though it cycled between the first and the second voltage states, thus acts as a deflection electrode to help deflect charged drops away from the initial trajectory 57 and toward the catcher 72. After passing the charging electrode 62, the drops 54 will travel in close proximity to the catcher face 74 which is typically constructed of a conductor or dielectric. The charges on the surface of the non-printing drops 68 will induce either a surface charge density charge (for a catcher face 74 constructed of a conductor) or a polarization density charge (for a catcher face 74 constructed of a dielectric). The induced charges on the catcher face 74 produce an attractive force on the charged non-printing drops 68. The attractive force on the non-printing drops 68 is identical to that which would be produced by a fictitious charge (opposite in polarity and equal in magnitude) located inside the ink catcher 72 at a distance from the surface equal to the distance between the ink catcher 72 and the non-printing drops 68. The fictitious charge is called an image charge. The attractive force exerted on the charged non-printing drops 68 by the catcher face 74 causes the charged non-printing drops 68 to deflect away from their initial trajectory 57 and accelerate along a non-print trajectory 86 toward the catcher face 74 at a rate proportional to the square of the droplet charge and inversely proportional to the droplet mass. In this embodiment the ink catcher 72, due to the induced charge distribution, comprises a portion of the deflection mechanism 70. In other embodiments, the deflection mechanism 70 can include one or more additional electrodes to generate an electric field through which the charged droplets pass so as to deflect the charged droplets. For example, an optional single biased deflection electrode 71 in front of the upper grounded portion of the catcher can be used. In some embodiments, the charging electrode 62 can include a second portion on the second side of the jet array, denoted by the dashed line electrode 62', which supplied with the same charging electrode waveform 64 as the first portion of the charging electrode 62.

In the alternative, when the drop formation waveform 60 applied to the drop forming transducer 28 causes a drop 54 to break off from the liquid stream 52 when the electrical potential of the charging electrode 62 is at the first voltage state 82 (FIG. 4) (i.e., at a relatively low potential or at a zero potential), the drop 54 does not acquire a charge. Such uncharged drops are unaffected during their flight by electric fields that deflect the charged drops. The uncharged drops therefore becomes printing drops 66, which travel in a generally undeflected path along the trajectory 57 and impact the print medium 32 to form a print dots 88 on the print medium 32, as the recoding medium is moved past the printhead 30 at a speed $V_m$. The charging electrode 62, deflection electrode 71 and ink catcher 72 serve as a drop selection system 69 for the printhead 30.

FIG. 4 illustrates how selected drops can be printed by the control of the drop formation waveforms supplied to the drop forming transducer 28. Section A of FIG. 4 shows a drop formation waveform 60 formed as a sequence that includes three drop formation waveform 92, and four drop formation waveforms 94. The drop formation waveforms 94 (denoted as 94-1, 94-2, 94-3, and 94-4) each have a period 96 and include a pulse 98, and each of the drop formation waveforms 92 (denoted as 92-1, 92-2, and 92-3) have a longer period 100 and include a longer pulse 102. In this example, the period 96 of the drop formation waveforms 94 is the fundamental period $T_o$, and the period 100 of the drop formation waveforms 92 is twice the fundamental period, $2T_O$. The drop formation waveforms 94 each cause individual drops to break off from the liquid stream. The drop formation waveforms 92, due to their longer period, each cause a larger drop to be formed from the liquid stream. The larger drops 54 formed by the drop formation waveforms 92 each have a volume that is approximately equal to twice the volume of the drops 54 formed by the drop formation waveforms 94.

As previously mentioned, the charge induced on a drop 54 depends on the voltage state of the charging electrode at the instant of drop breakoff. The B section of FIG. 4 shows the charging electrode waveform 64 and the times, denoted by the diamonds, at which the drops 54 break off from the liquid stream 52. The waveforms 92-1, 92-2, 92-3 cause large drops 104-1, 104-2, 104-3 to break off from the liquid stream 52 while the charging electrode waveform 64 is in the second voltage state 84. Due to the high voltage applied to the charging electrode 62 in the second voltage state 84, the large drops 104-1, 104-2, 104-3 are charged to a level that causes them to be deflected as non-printing drops 68 such that they strike the catcher face 74 of the ink catcher 72 in FIG. 3. These large drops may be formed as a single drop (denoted by the double diamond for 104-1), as two drops that break off from the liquid stream 52 at almost the same time that subsequently merge to form a large drop (denoted by two closely spaced diamonds for 104-2), or as a large drop that breaks off from the liquid stream that breaks apart and then merges back to a large drop (denoted by the double diamond for 104-3). The waveforms 94-1, 94-2, 94-3, 94-4 cause small drops 106-1, 106-2, 106-2, 106-3, 106-4 to form. Small drops 106-1 and 106-3 break off during the first voltage state 82, and therefore will be relatively uncharged; they are not deflected into the ink catcher 72, but rather pass by the ink catcher 72 as printing drops 66 and strike the print media 32 (see FIG. 3). Small drops 106-2 and 104-4 break off during the second voltage state 84 and are deflected to strike the ink catcher 74 as non-printing drops 68. The charging electrode waveform 64 is not controlled by the pixel data to be printed, while the drop formation waveform 60 is determined by the print data. This type of drop deflection is known and has been described in, for example, U.S. Pat. No. 8,585,189 (Marcus et al.); U.S. Pat. No. 8,651,632 (Marcus); U.S. Pat. No. 8,651,633 (Marcus et al.); U.S. Pat. No. 8,696,094 (Marcus et al.); and U.S. Pat. No. 8,888,256 (Marcus et al.), each of which is incorporated herein by reference.

Figure 5:
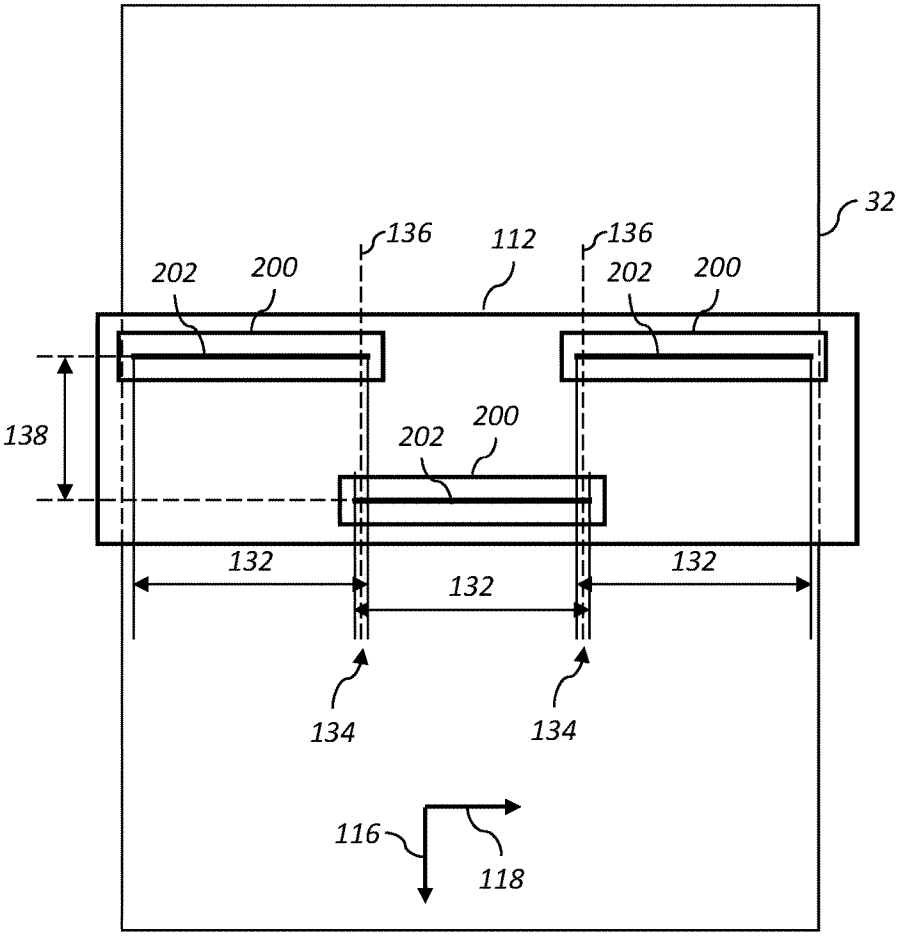
FIG. 5 (Prior Art)
FIG. 5 shows a top view of an exemplary printhead assembly including a staggered array of jetting modules.

FIG. 5 is a diagram of an exemplary inkjet printhead assembly 112. The printhead assembly 112 includes a plurality of jetting modules 200 arranged across a width dimension of the print medium 32 in a staggered array configuration. The width dimension of the print medium 32 is the dimension in cross-track direction 118, which is perpendicular to in-track direction 116 (i.e., the motion direction of the print medium 32). Such printhead assemblies 112 are sometimes referred to as "lineheads."

Each of the jetting modules 200 includes a plurality of inkjet nozzles arranged in nozzle array 202, and is adapted to print a swath of image data in a corresponding printing region 132. Commonly, the jetting modules 200 are arranged in a spatially-overlapping arrangement where the printing regions 312 overlap in overlap regions 134. Each of the overlap regions 134 has a corresponding centerline 136. In the overlap regions 134, nozzles from more than one nozzle array 202 can be used to print the image data.

Stitching is a process that refers to the alignment of the printed images produced from jetting modules 200 for the purpose of creating the appearance of a single page-width line head. In the exemplary arrangement shown in FIG. 2, three printheads 200 are stitched together at overlap regions 134 to form a page-width printhead assembly 112. The page-width image data is processed and segmented into separate portions that are sent to each jetting module 200 with appropriate time delays to account for the staggered positions of the jetting modules 200. The image data portions printed by each of the jetting modules 200 is sometimes referred to as "swaths." Stitching systems and algorithms are used to determine which nozzles of each nozzle array 202 should be used for printing in the overlap region 134. Preferably, the stitching algorithms create a boundary between the printing regions 132 that is not readily detected by eye. One such stitching algorithm is described in commonly-assigned U.S. Pat. No. 7,871,145 (Enge), which is incorporated herein by reference.

The two lines of nozzle arrays 202 in the staggered arrangement are separated by a nozzle array spacing 138. It has been found that larger nozzle array spacing 138 result in large amplitudes of the stitching variation, even after stitching correction algorithms are applied. Therefore, it is desirable to reduce the nozzle array spacing 138 as much as possible. With prior art arrangements for mounting the nozzle arrays 202, such as that described in the aforementioned, commonly-assigned U.S. Pat. No. 8,226,215 there is a limit to how small the nozzle array spacing 138. These methods also get expensive and cumbersome when it is necessary to accommodate larger and larger print widths. These limitations are addressed with the modular inkjet printhead assembly described herein.

Figure 6:
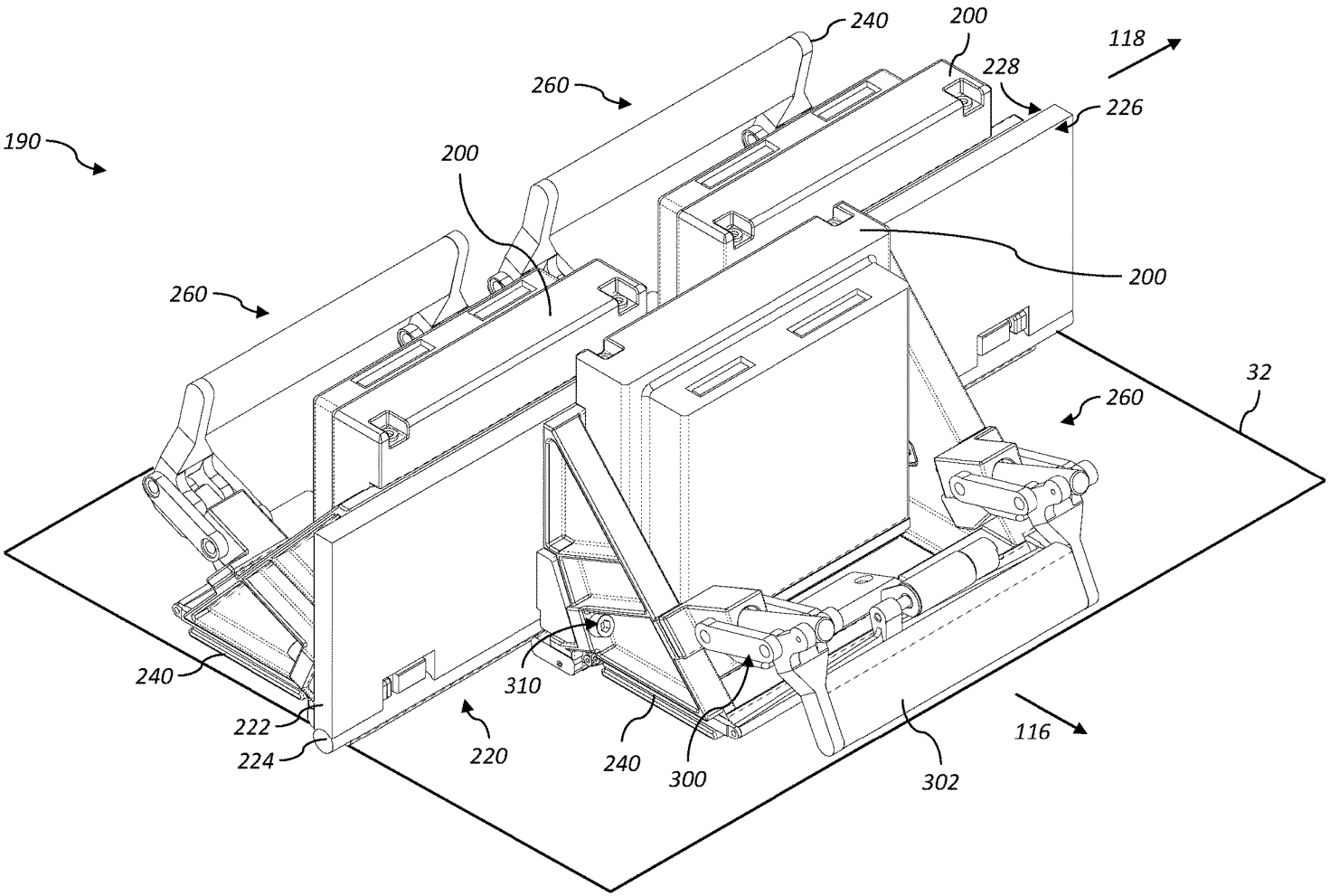
FIG. 6 shows an exemplary modular printhead assembly including a plurality of printhead modules mounted onto a central rail assembly in accordance with the present invention.

FIG. 6 shows an exemplary modular printhead assembly 190 including a plurality of printhead modules 260 in accordance with the present invention. Each printhead module 260 includes a jetting module 200 and a mounting assembly 240. The printhead modules 260 are mounted onto a central rail assembly 220, which includes a rod 224 attached onto the side of a beam 222 that faces the print medium 32. The print medium 32 moves past the printhead assembly 190 in an in-track direction 116. The rail assembly 240 extends across the width of the print medium 32 in a cross-track direction 118.

In the illustrated configuration, the printhead assembly 190 includes three printhead modules 260, with one being mounted on a downstream side 226 of the rail assembly 220, and two being mounted on an upstream side 228 of the rail assembly 220. An advantageous feature of this modular printhead assembly 190 design is that wider print media 32 can be supported by simply extending the length of the rail assembly 220 and adding additional printhead modules 260. By alternating the printhead modules 260 between the downstream side 226 and the upstream side 228 of the rail assembly 220, the associated nozzle arrays 202 can be stitched together with appropriate overlap regions 134 (see FIG. 5).

Figure 7:
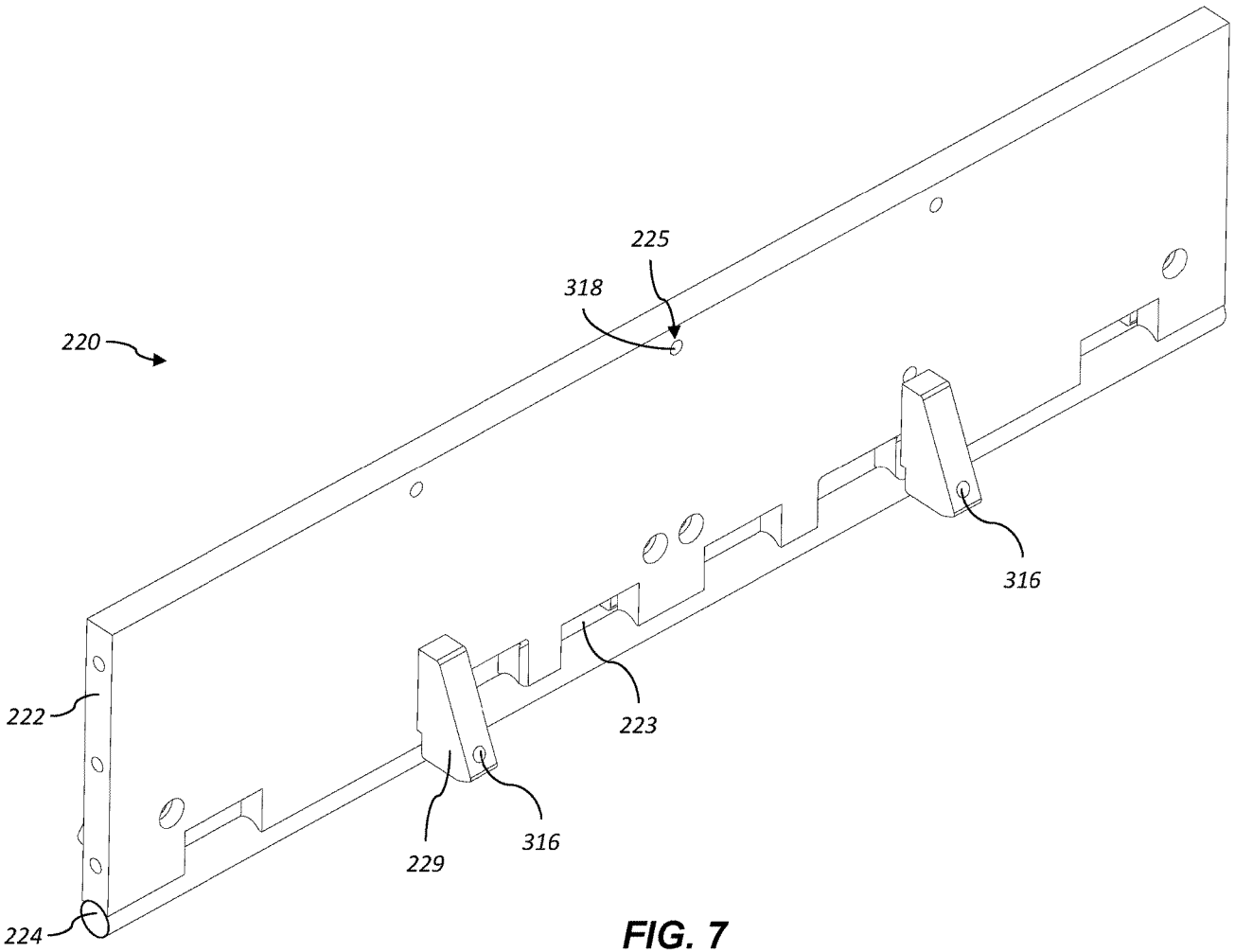
FIG. 7 illustrates additional details of the rail assembly in the modular printhead assembly of FIG. 6.

FIG. 7 shows additional details for an exemplary embodiment of the rail assembly 220 of FIG. 6. The rail assembly 220 includes rod 224, which is attached to the bottom side of beam 222 (i.e., the side that faces the print medium 32 (FIG. 6). Mounting brackets are attached to the beam 222 for used for clamping the mounting assembly 240 to the rail assembly 220.

In the illustrated configuration, the rod 224 has a cylindrical shape, and the bottom side of the beam 222 has a concave profile that matches the shape of the outer surface of the rod 224. In other configurations, the beam and the rod 224 can have different shapes. For example, the bottom side of the beam 222 can have a v-shaped groove that sits on the outer surface of the rod 224. In another example, the rod 224 can have a cylindrical shape around a portion of the circumference, but can have a flat surface on one side to facilitate attaching the rod 224 to a beam 222 having a flat bottom side. The rod 224 can be attached to the beam 222 using any appropriate means. For example, bolts can be inserted through holes in the rod 224 into corresponding threaded holes in the bottom side of the beam 222.

The beam 222 includes a series of notches 223 that are adapted to receive tabs on the jetting modules 200 and the mounting assemblies 240 (FIG. 6) as will be discussed later. In an exemplary embodiment, two notches 223 are provided for each of the printhead modules 260 (FIG. 6) at locations corresponding to the positions of the tabs, which are preferably provided in proximity to first and second ends the jetting modules 200 and the mounting assemblies 240. (Within the context of the present disclosure, "in proximity" to an end means that the distance between the end and the notch is no more than 20% of the distance between the two ends.) In the illustrated configuration, the notches 223 extend all the way through the beam 222. In other configurations, the notches 223 may extend only part of the way through. As will be discussed later, the beam also includes rotational alignment features 225 that are adapted to engage with a corresponding datum on the mounting assemblies 240 or the jetting modules 200.

Figure 8:
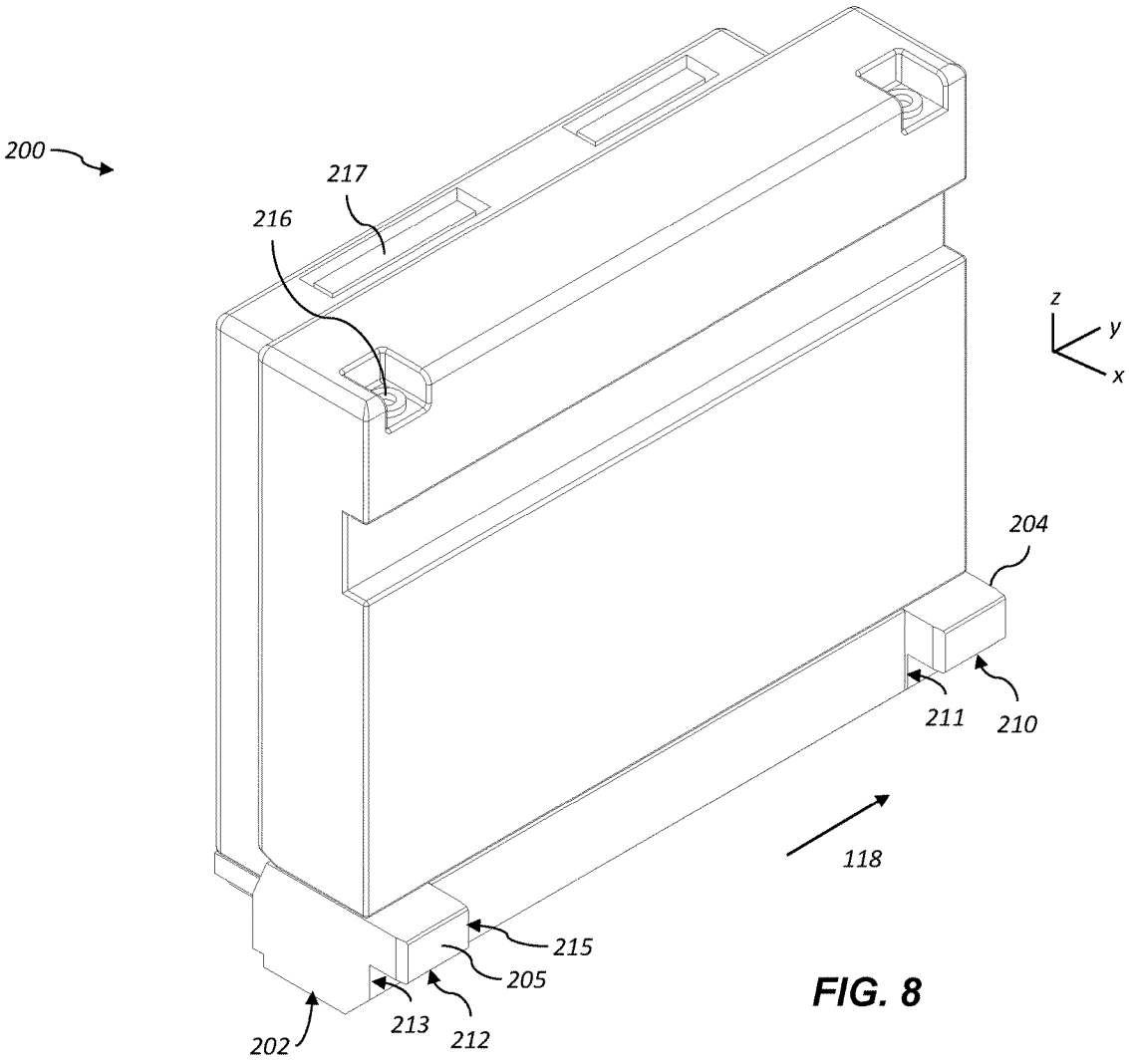
FIG. 8 illustrates additional details of the jetting modules in the modular printhead assembly of FIG. 6.

FIG. 8 shows additional details for an exemplary embodiment of the jetting module 200 of FIG. 6. A nozzle array 220 (not visible in FIG. 8) extends across the width of the jetting module 200 in the cross track direction 118. Fluid connections 216 and electrical connections 217 connect to other components of the printer system 20 (FIG. 1).

The jetting module 200 includes first and second alignment tabs 204, 205 spaced apart in the cross-track direction 118 that are configured to be inserted into the notches 223 in the beam 222 and engage with the rod 224 of the rail assembly 220 (FIG. 7). In order to define the desired position of the jetting module 200 relative to the rail assembly 220 requires constraining six degrees of freedom using six alignment features. The first alignment tab 204 provides a first alignment datum 210 and a second alignment datum 211. The second alignment tab 205 provides a third alignment datum 212 and a fourth alignment datum 213. The engagement between the first and second alignment tabs 204, 205 with the rod 224 define four degrees of freedom (x, z, $\theta_x$, $\theta_z$).

The jetting module 200 also includes a rotational alignment feature providing a fifth alignment datum 214 (not visible in FIG. 8), which is adapted to engage with a corresponding rotational alignment feature associated with the beam 222 to define the fifth degree of freedom ($\theta_y$). The rotational alignment feature associated with the beam 222 may be on the beam 222 itself, or can be on the mounting assembly 240, which is in a predefined position relative to the beam 222. In the illustrated configuration, the fifth alignment datum 214 is on the bottom surface of the jetting module 200, and contacts a component of the mounting assembly 240 (see FIG. 12B).

The jetting module 200 also includes a cross-track alignment feature providing a sixth alignment datum 215, which is adapted to engage with a corresponding cross-track alignment feature on the rail assembly 220 to define the sixth degree of freedom (y). In the illustrated configuration, the sixth alignment datum 215 is provided on a side face of the second alignment tab 205, and the corresponding cross-track alignment feature on the rail assembly 220 is provided by a side face of the corresponding notch 223 in the beam 222. While the sixth alignment datum 215 is shown on the inside face of the second alignment tab 205, one skilled in the art will recognize that it could alternatively be on the outside face. In other configurations, the sixth alignment datum 215 can be a side face of the first alignment tab 204, or can be provided by some other feature on the jetting module 200.

The first and second alignment tabs 204, 205 of the jetting module 200 can take any appropriate form. FIGS. 9A-9E illustrate a number of exemplary configurations that can be used. Each configuration includes a "v-shaped" notch 206, which is formed into the alignment tab 204. The notch 206 has two faces 207, 208, each of which provides a corresponding alignment datum 210, 211 at the location where the alignment tab 204 contacts the rod 224. In the illustrated examples, the faces 207, 208 are oriented at 90° to each other, but this is not a requirement. Fixtures can be provided during the manufacturing process for the jetting module 200 to accurately machine the positions of the faces 207, 208 relative to the position of the nozzle array 202, so that the nozzle array 202 can be accurately aligned relative to the rail assembly 220.

Figure 9C:
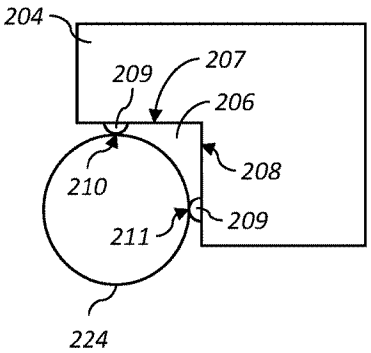
FIGS. 9A-9E illustrate exemplary alignment tab configurations.
Figure 9B:
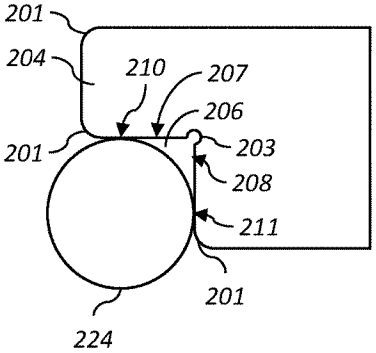
Figure 9A:
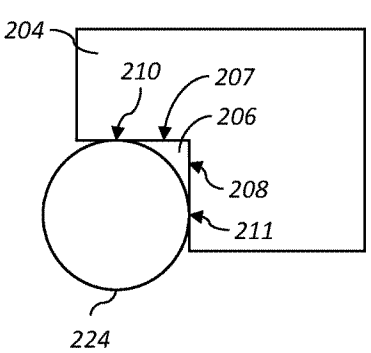
Figure 9E:
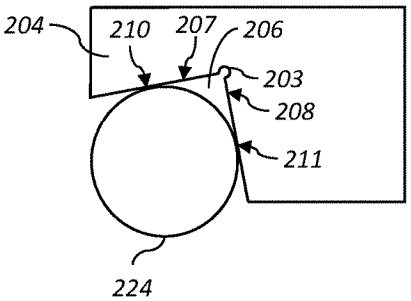
Figure 9D:
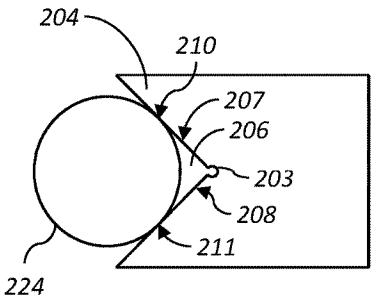

In FIG. 9A the notch 206 has sharp corners and includes a horizontal face 210 and a vertical face 211. The alignment tab 204 of FIG. 9B is similar except that the outer corners include fillets 201 and the inner corner includes an endmill 203. The alignment tab 204 of FIG. 9C includes protrusions 209 which provide the contact points (alignment datum 210 and alignment datum 211) with the rod 224. For example, the protrusions 209 can be ball bearings that provide a single point of contact. In FIGS. 9D and 9E the notches 206 are rotates so that the faces 207, 208 are diagonal. In FIG. 9D, the faces 207, 208 are oriented at ±45° relative to the horizontal. In FIG. 9E, the face 207 tilts backward by a small angle (e.g., about 10°). This has the advantage that the downward weight of the jetting module 200 will have the effect of pulling the jetting module 200 toward the rail assembly 220.

Figure 10:
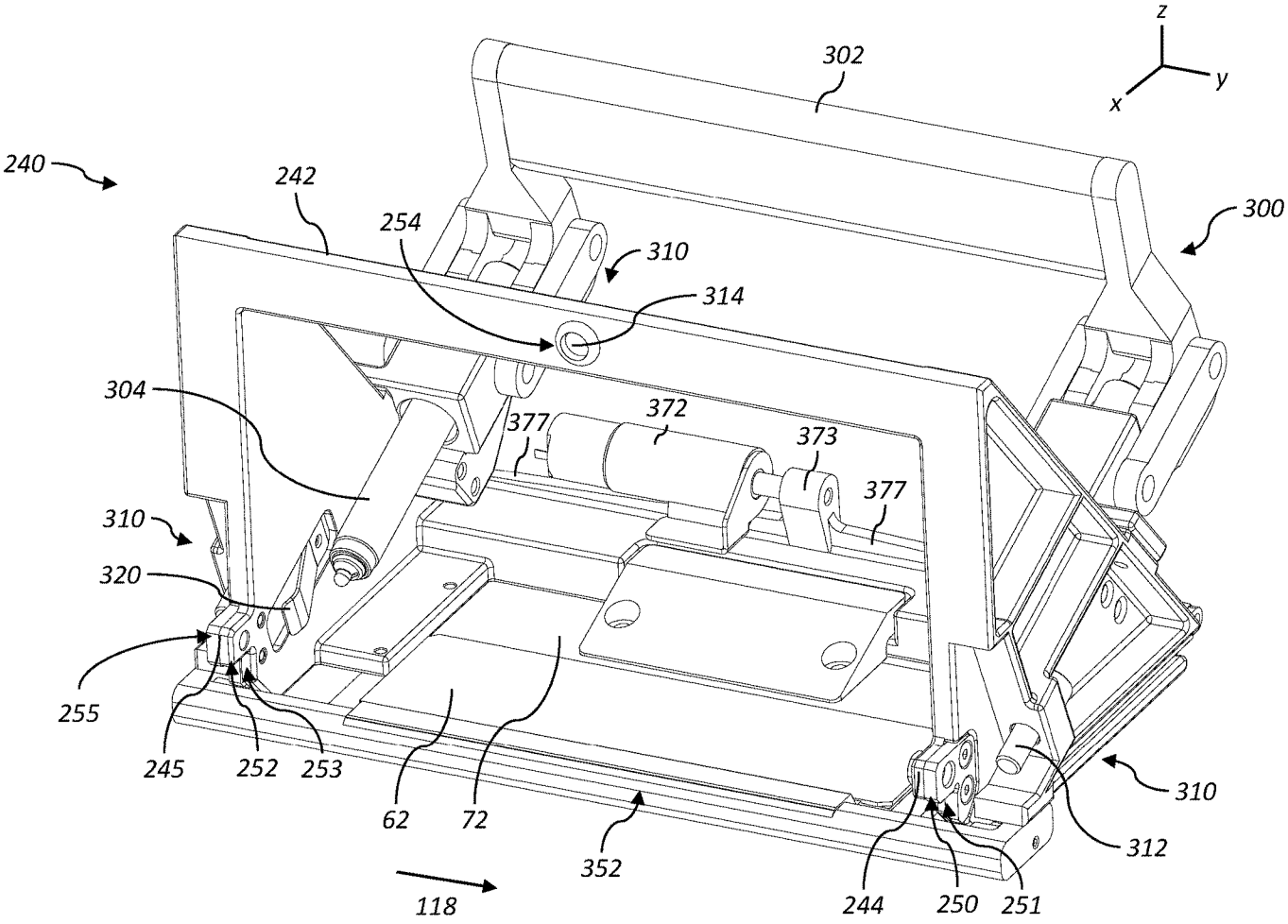
FIG. 10 illustrates additional details of the mounting assemblies in the modular printhead assembly of FIG. 6.

FIG. 10 shows additional details for an exemplary embodiment of the mounting assembly 240 of FIG. 6. The mounting assembly 240 includes third and fourth alignment tabs 244, 245 protruding from a frame 242. The alignment tabs 244, 245 are spaced apart in the cross-track direction 118 and are configured to be inserted into the notches 223 in the beam 222 and engage with the rod 224 of the rail assembly 220 (FIG. 7). The alignment tabs 244, 245 of the mounting assembly 240 can take any appropriate form that provides two contact points with the rod 224, such as those shown in FIGS. 9A-9E.

In order to define the desired position of the mounting assembly 240 relative to the rail assembly 220 requires constraining six degrees of freedom using six alignment features. The third alignment tab 244 provides a seventh alignment datum 250 and an eighth alignment datum 251. The fourth alignment tab 245 provides a ninth alignment datum 252 and a tenth alignment datum 253. The engagement between the alignment tabs 244, 245 with the rod 224 therefore define four degrees of freedom (x, z, $\theta_x$, $\theta_z$).

The mounting assembly 240 also includes a rotational alignment feature providing an eleventh alignment datum 254, which is adapted to engage with a corresponding rotational alignment feature 225 (FIG. 7) on the beam 222 to define the fifth degree of freedom ($\theta_y$). In the illustrated configuration, the eleventh alignment datum 254 is a ring that protrudes slightly from the upper cross-piece of the frame 242.

The mounting assembly 240 also includes a cross-track alignment feature providing a twelfth alignment datum 255, which is adapted to engage with a corresponding cross-track alignment feature on the rail assembly 220 to define the sixth degree of freedom (y). In the illustrated configuration, the twelfth alignment datum 255 is provided on a side face of the fourth alignment tab 244, and the corresponding cross-track alignment feature on the rail assembly 220 is provided by a side face of the corresponding notch 223 in the beam 222. While the twelfth alignment datum 255 is shown on the outside face of the fourth alignment tab 205, one skilled in the art will recognize that it could alternatively be on the inside face. In other configurations, the twelfth alignment datum 255 can be a side face of the third alignment tab 245, or can be provided by some other feature on the mounting assembly 240.

A mounting assembly clamping mechanism 310 is used to apply a clamping force to the mounting assembly 240 clamping it to the rail assembly 220. The clamping force causes the seventh alignment datum 250, the eighth alignment datum 251, the ninth alignment datum 252, and the tenth alignment datum 253 of the mounting assembly 240 to engage with the rod 224, and causes the eleventh alignment datum 254 of the mounting assembly 240 to engage with the corresponding alignment feature 225 (FIG. 7) on the beam 222. In the illustrated configuration, the mounting assembly clamping mechanism 310 is provided by three bolts 312. One of the bolts 312 is shown on one side of the mounting assembly 240 in proximity to the third alignment tab 244. This bolt 312 threads into a threaded hole 316 on the mounting bracket 229 (see FIG. 7), which is attached to the beam 222. Likewise another bolt 312 (not visible in FIG. 10) will be on the other side of the mounting assembly 240 in proximity to the fourth alignment tab 245. A third bolt 312 (not shown in FIG. 10) would be inserted through the bolt hole 314 shown in the top rail of the frame 242 and into a threaded hole 318 on the beam 222 at a position corresponding to the rotational alignment feature 225 (see FIG. 7). It will be obvious to one skilled in the art that a variety of other types of mounting assembly clamping mechanisms 310 can be used in accordance with the present invention, including various spring clamp arrangements.

In the illustrated exemplary embodiment, the ink catcher 72 is attached to the frame 242 of the mounting assembly 240. The charging electrode 62 is then attached to the ink catcher 72. A shutter mechanism 352 is also attached to the frame 242 of the mounting assembly 240. The shutter mechanism is used to block the path of ink between the nozzles 50 and the print medium 32 (see FIG. 3) when the jetting module 200 is not being used to print image data. Motor 372 is a component of the shutter mechanism 352. The shutter mechanism 352 will be discussed in more detail later.

A jetting module clamping mechanism 300 is provided for each jetting module 200. In the illustrated exemplary embodiment, the jetting module clamping mechanism 300 is a component of the mounting assembly 240. The jetting module clamping mechanism 300 applies a force to the associated jetting module 200 that causes the first alignment datum 210, the second alignment datum 211, the third alignment datum 212 and the fourth alignment datum 213 of the associated jetting module 200 to engage with the rod 224 and causes the fifth alignment datum 214 to engage with a corresponding rotational alignment feature associated with the beam 222. In the illustrated configuration, the fifth alignment datum 214 is on the bottom surface of the jetting module 200, and contacts a corresponding rotational alignment feature the mounting assembly 240. As can be seen in FIG. 12B, the rotational alignment feature in this example is on a top surface of the ink catcher 72, which is a component of the mounting assembly 240, and will therefore have a defined positional relationship to the beam 222.

In the illustrated exemplary embodiment, the jetting module clamping mechanism 300 is a spring loaded toggle clamp mechanism that can be operated by a human operator who is installing the jetting module 200 into the printhead assembly 190 (FIG. 6). The spring loaded toggle clamp mechanism includes a handle 302 connected to two spring plungers 304 using a lever mechanism. When the operator lifts the handle 302, the two spring plungers 302 are pushed against corresponding surfaces of the jetting module 200, thereby pushing the jetting module against the rail assembly 220. Additional details of the spring loaded toggle clamp mechanism can be seen more clearly in FIG. 12D.

A cross-track force mechanism 320 is also provided for each jetting module 200. In the illustrated exemplary embodiment, the cross-track force mechanism 300 is a leaf spring mechanism which is attached to the frame 242 of the mounting assembly 240. When the jetting module is inserted into the mounting assembly 240, the leaf spring applies a cross-track force on the jetting module 200 (to the right with respect to FIG. 10), which causes the sixth alignment datum 215 (see FIG. 8) to engage with a corresponding cross-track alignment feature on the beam 222. In this case, the inner surface of the second alignment tab 205 is pushed against the side face of the corresponding notch 223 in the beam 222. The cross-track force mechanism 320 also serves to apply a cross-track force on the mounting assembly 240 (to the left with respect to FIG. 10), which causes the twelfth alignment datum 255 to be pushed against the side face of the corresponding notch 223 in the beam 222, thereby engaging with a corresponding cross-track alignment feature on the beam 222. In other configurations, the cross-track force mechanism 320 can utilize other types of spring mechanisms, or can utilize any other type of force mechanisms known in the art that are adapted to provide a cross-track force (e.g., screw mechanisms, hydraulic mechanisms or toggle clamp mechanisms).

Figure 11:
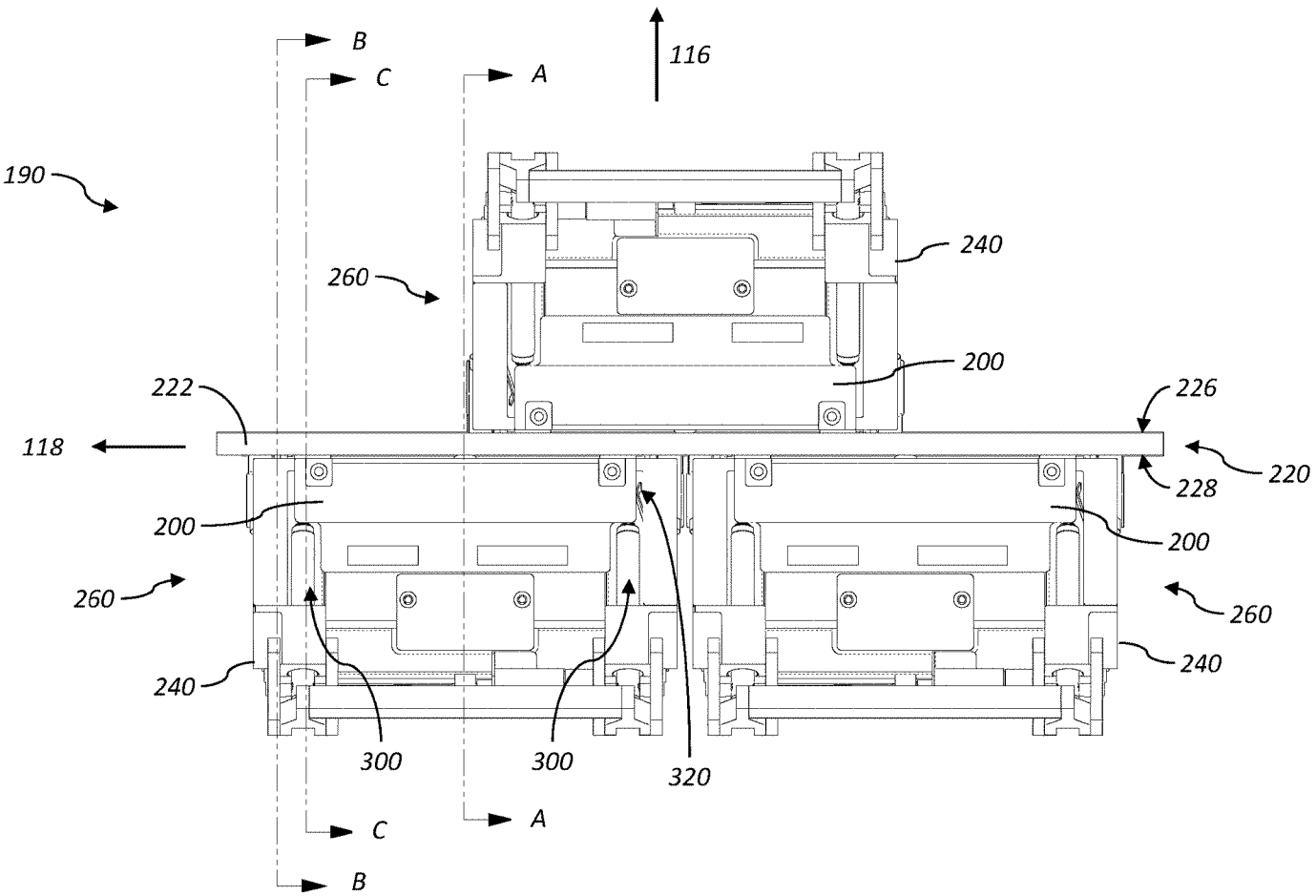
FIG. 11 shows a top view of the modular printhead assembly of FIG. 6.

FIG. 11, shows a top view of the printhead assembly 190 of FIG. 6, which includes one printhead module 260 mounted on the downstream side 226 of the rail assembly 220, and two printhead modules 260 mounted on the upstream side 228 of the rail assembly 220. Some aspects of the various components can be seen more clearly in this view. The cut-lines are shown corresponding to the views of FIGS. 12A-12D.

Figure 12A:
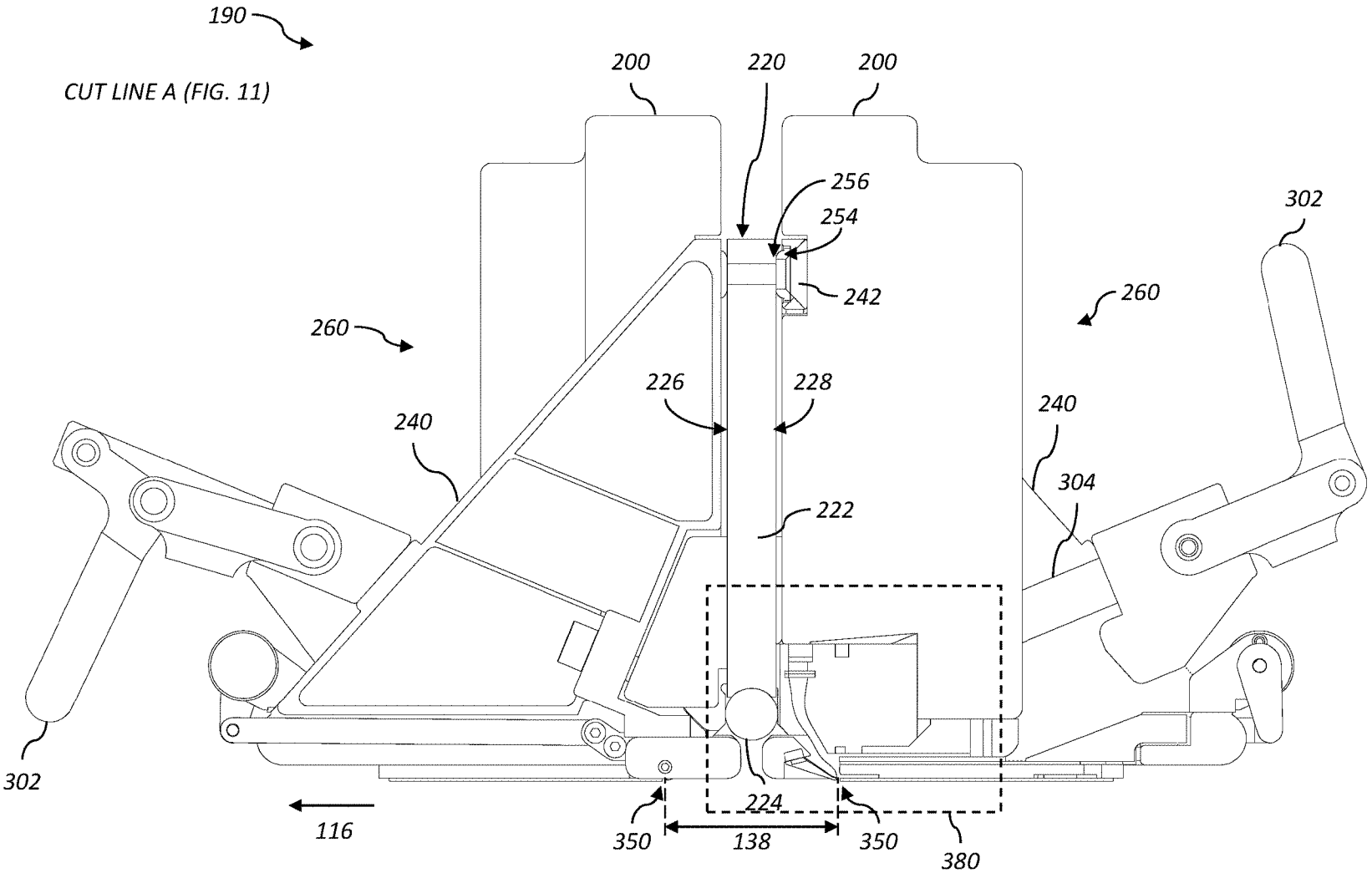
FIGS. 12A-12D show cross-section views of the modular printhead assembly of FIG. 6.
Figure 12B:
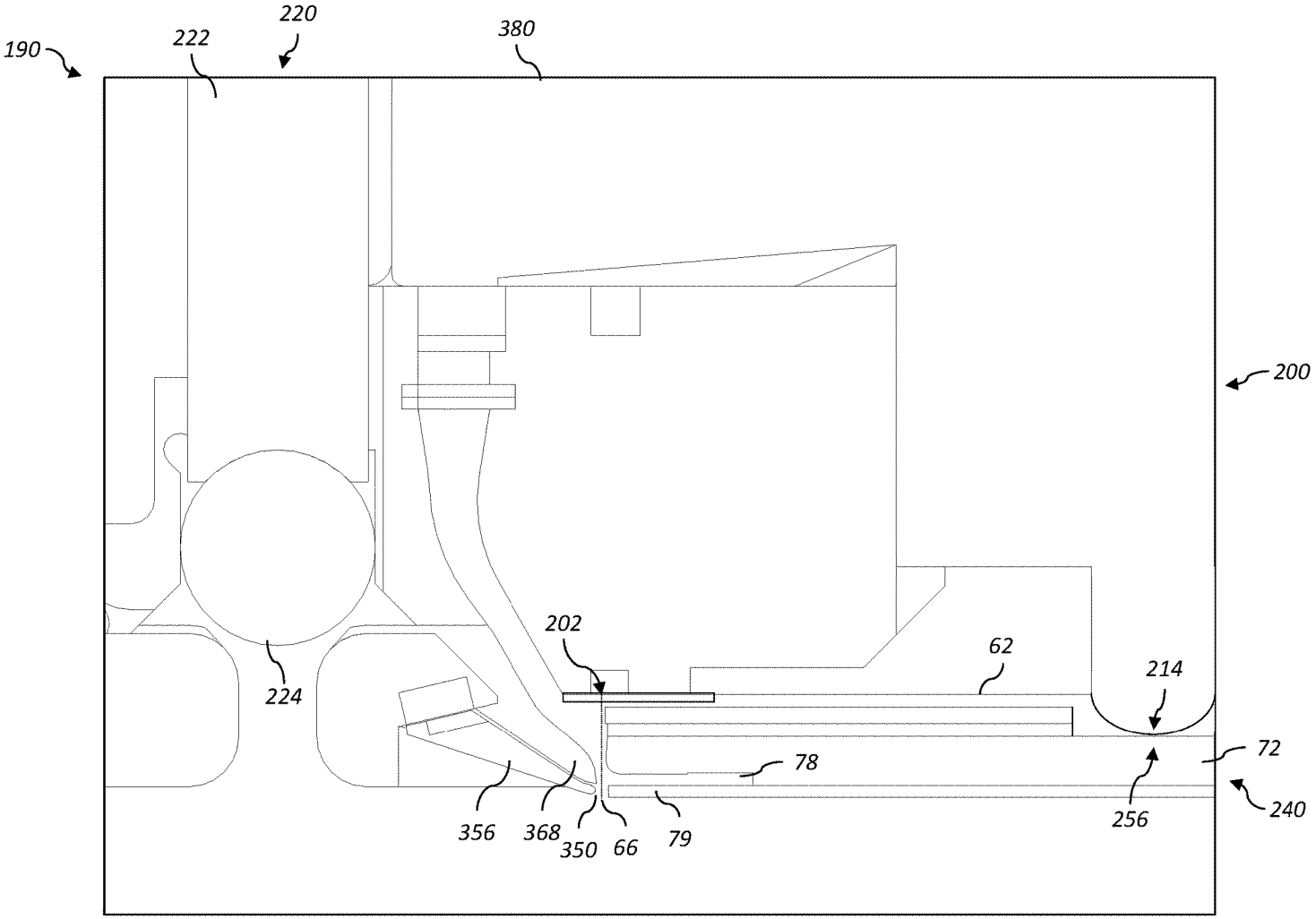

FIG. 12A corresponds to cut-line A in FIG. 11, which passes through the center of the left-most printhead module 260. FIG. 12B is an enlarged view of the region 380 in FIG. 12A, showing additional details. A number of features of the printhead assembly 190 can be observed in these view. Slots 350 are provided in the lower surface of each printhead module 260 corresponding to the in-track positions of the nozzle arrays 202. The nozzle array spacing 138 is defined by the in-track distance between the two slots 350. As discussed earlier, it is desirable to minimize the nozzle array spacing 138 to reduce stitching errors. An advantage of the exemplary embodiment of printhead assembly 190 is that the slots 350 can be positioned quite close to the rail assembly 220. This is partially due to the fact that the ink catcher 72 is positioned upstream of the nozzle array 202 for the jetting module 200 on the upstream side 228 of the rail assembly 220, and the ink catcher 72 is positioned downstream of the nozzle 202 array for the jetting module 200 on the downstream side of the rail assembly 220. Because the ink catchers 72 extend out a significant distance from the nozzle arrays 202, prior art system where the ink catchers 72 were all positioned on the same side of the nozzle arrays 202 required that the nozzle array spacing 138 be significantly larger.

The eleventh alignment datum 254 on the frame 242 of the mounting assembly 240 can also be seen. The mounting assembly clamping mechanism 310 (FIG. 10), pushes the alignment datum 254 into a corresponding rotational alignment feature 256 on the beam 222 of the rail assembly 220.

FIG. 12B shows an enlargement of the region 380 in FIG. 12A, and more clearly illustrates the portion of the printhead assembly 190 in the vicinity of the nozzle array 202. Undeflected printing drops 66 pass through a slot 350 formed between air guide 368 and the lower plate 79 of the ink catcher 72. Repositionable shutter blade 356 can be selectively repositioned to block the slot 350, as will be discussed in more detail later. The liquid channel 78 of the ink catcher 72 draws away non-printing drops 68 (FIG. 4) for recycling. In the illustrated configuration, the fifth alignment datum 214 of the jetting module 200 is provided by a protrusion which extends from the lower surface of the jetting module. The fifth alignment datum 214 contacts an upper surface of the ink catcher 72, which provides the rotational alignment feature 256. The ink catcher 72 is a component of the mounting assembly 240, which is mounted onto the rail assembly 220 in a predefined location, with the rotational alignment being defined relative to the beam 222 as has been discussed earlier. The rotational alignment feature 256 is therefore indirectly associated with the beam 222, even though it is not directly on the beam 222. In other embodiments, the fifth alignment datum 214 can be located in a different position on the jetting module 200. For example, the fifth alignment datum 214 can be a protrusion on the face of the jetting module that faces the beam 222. The rotational alignment feature 225 can then be a point on the beam 222, or on the frame 242 (FIG. 10) of the mounting assembly 240.

Figure 12C:
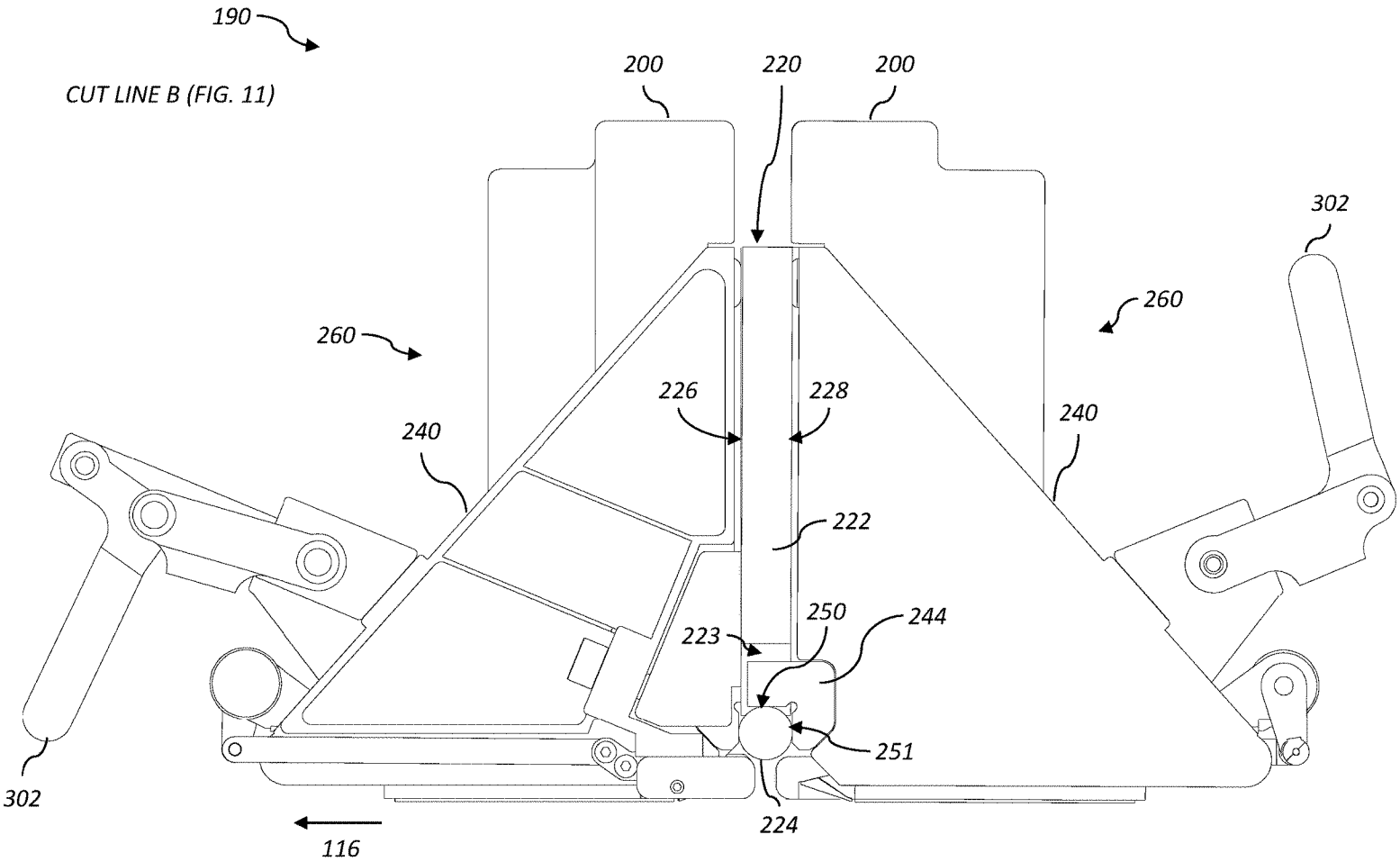

FIG. 12C corresponds to cut-line B in FIG. 11, which passes through alignment tab 244 of the mounting assembly 240 in the left-most printhead module 260 in FIG. 11 (i.e., the upstream printhead module 260 on the right-hand side of FIG. 12C). It can be seen that the alignment tab 244 is inserted partway through the notch 223 in beam 222, and that the seventh alignment datum 250 and the eighth alignment datum 251 are in contact with the rod 224.

Figure 12D:
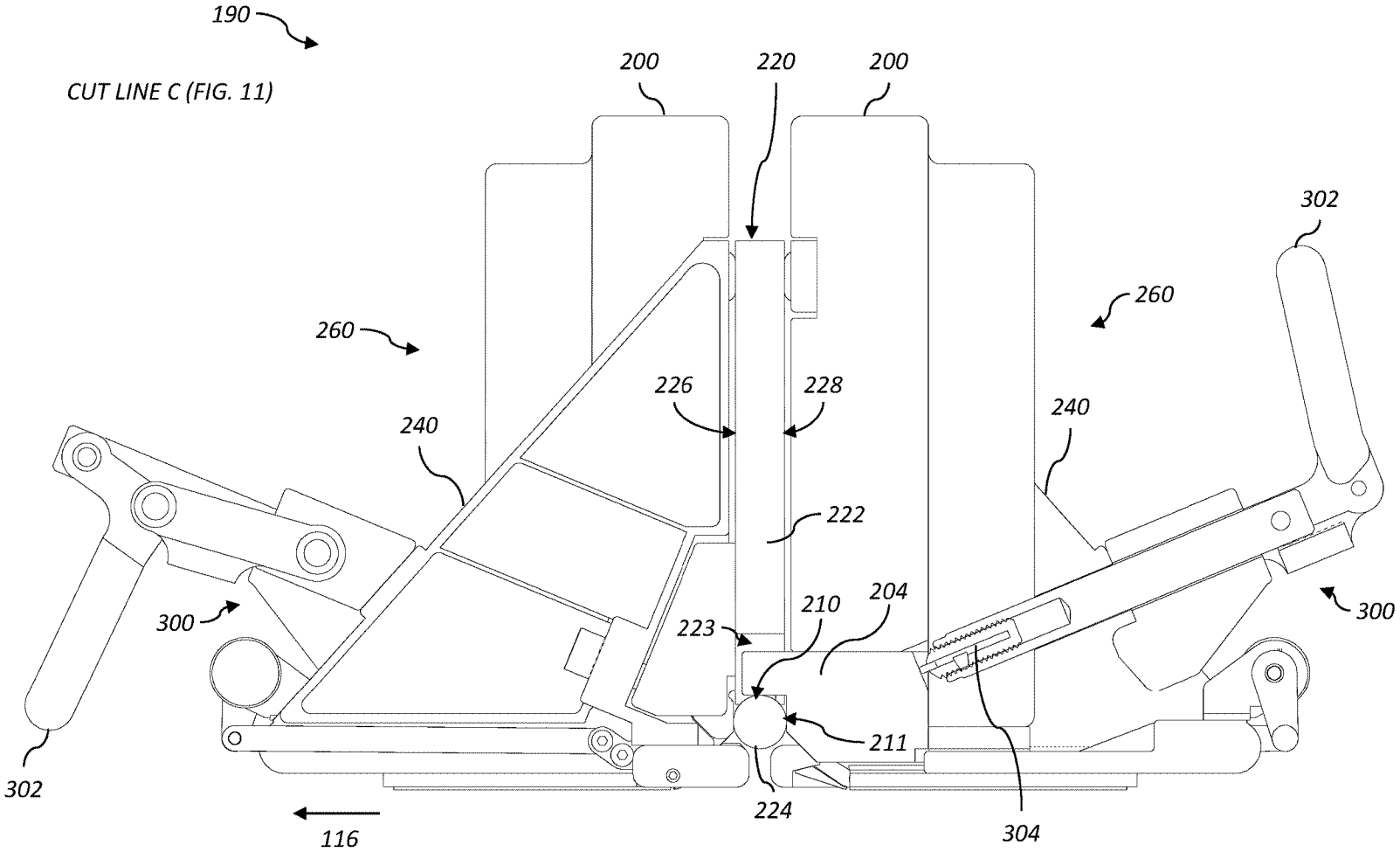

FIG. 12D corresponds to cut-line C in FIG. 11, which passes through the alignment tab 204 of the jetting module 200 in the left-most printhead module 260 in FIG. 11 (i.e., the upstream printhead module 260 on the right-hand side of FIG. 12C). Cut-line C also passes through the spring plunger 304 of the upstream printhead module 260. The handle 302 of the jetting module clamping mechanism 300 for the upstream printhead module 260 has been pushed upward into the engaged position, so that the spring plunger 304 is applying a force onto an angled surface along one side of the jetting module 200. This pushes the alignment tab 204 of the jetting module 200 tightly against the beam 222 of the rail assembly 220. It can be seen that the alignment tab 204 is inserted partway through the notch 223 in beam 222, and that the first alignment datum 250 and the second alignment datum 251 are in contact with the rod 224. A second spring plunger 304 (not visible in FIG. 12D) is similarly applying a force onto an angled surface along the other side of the jetting module 200, thereby engaging the second alignment tab 205 with the rod 224. A downward component of the force provided by the jetting module clamping mechanism 300 also pushes downward on the jetting module 200 so that the fifth alignment datum 214 engages with the corresponding rotational alignment feature 256 on the mounting assembly 240 (as discussed with respect to FIG. 12B). The handle 302 of the jetting module clamping mechanism 300 for the downstream printhead module 260 on the left side of FIG. 12D has been pushed downward into the released position, so that the spring plungers 304 have been pulled away from the jetting module 200. This enables the jetting module 200 to be extracted from the printhead assembly 190 (e.g., for maintenance).

Figure 13A:
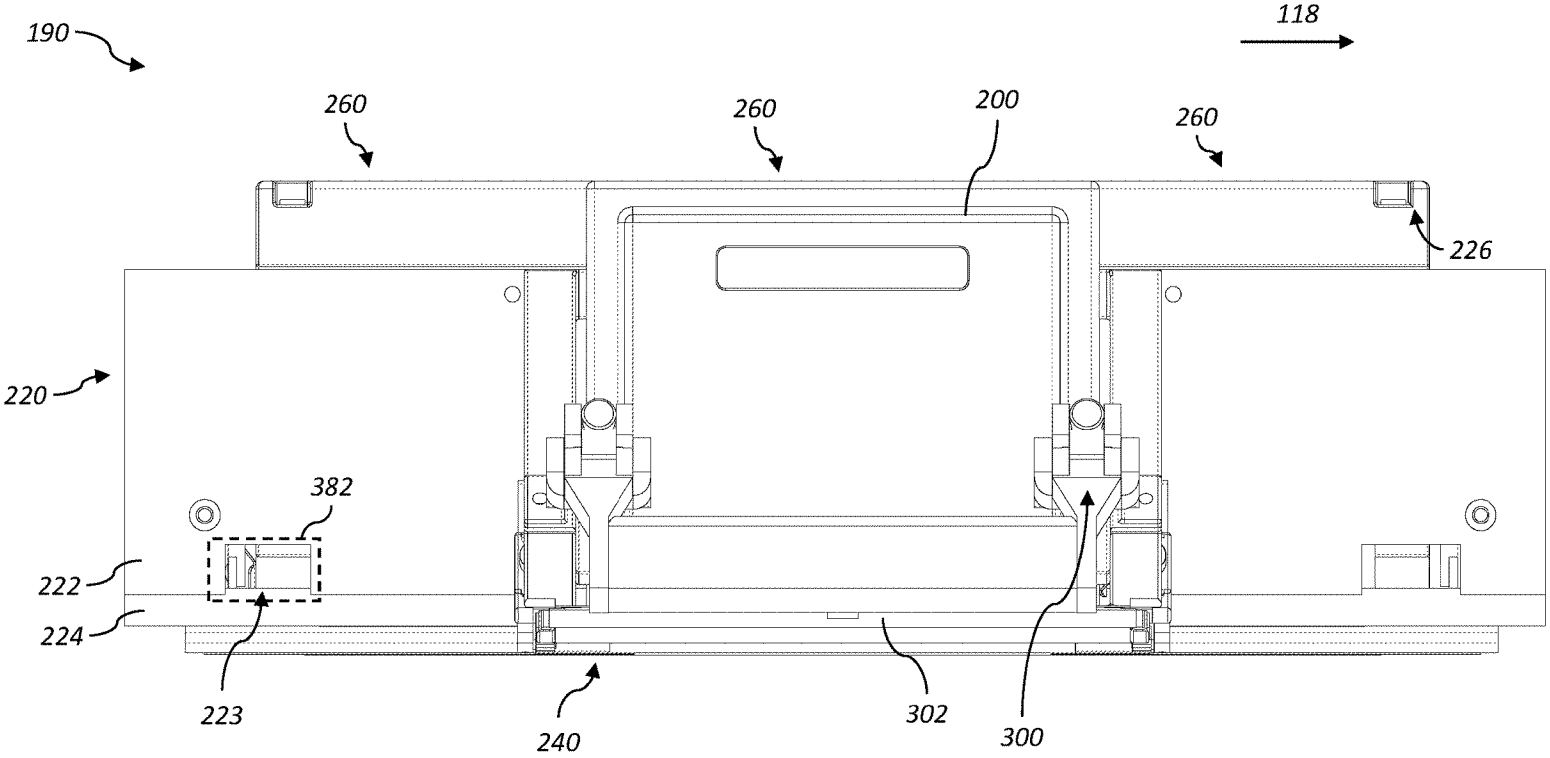
FIGS. 13A-13B show side views of the modular printhead assembly of FIG. 6.

FIG. 13A shows a side view of the printhead assembly 190 of FIG. 6 as viewed from the downstream side 226. One printhead module 260 is visible on the downstream side 226 of the rail assembly 220, with the other two printhead modules 260 being behind the rail assembly 220 on the upstream side 228 (FIG. 6).

Figure 13B:
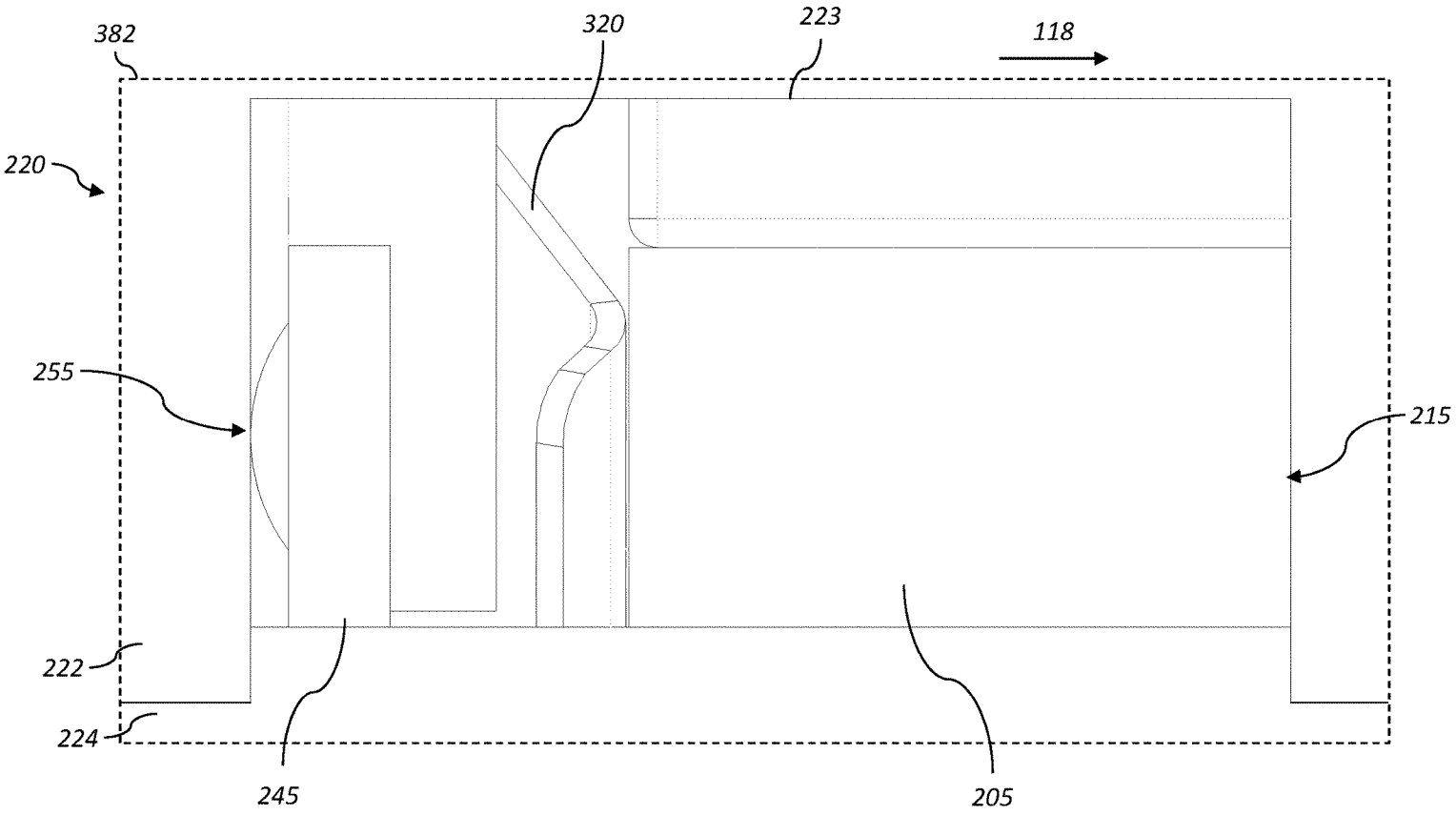

FIG. 13B shows an enlargement of the region 382 in FIG. 13A, and more clearly illustrates the portion of the printhead assembly 190 in the vicinity of the one of the notches 223 in the beam 220. Alignment tab 245 of the mounting assembly 240 (see FIG. 10) and alignment tab 205 of the jetting module 200 (see FIG. 8) in the left printhead module 260 behind the rail assembly 220 are visible within the notch 223. The leaf spring which serves as the cross-track force mechanism 320 (see FIG. 10) is visible between the alignment tabs 205, 245. The cross-track force mechanism 320 applies a cross-track force to both the mounting assembly 240 and the jetting module 200.

In the illustrated exemplary embodiment, the cross-track force mechanism 320 pushes the mounting assembly 240 to the left so that the alignment datum 255 on the outer face of the alignment tab 245 contacts the left face of the notch 223, which serves as the corresponding cross-track alignment feature associated with the beam 222. As discussed earlier, in other embodiments, other features on the mounting assembly 240 can serve as the alignment datum 245.

Similarly, in the illustrated exemplary embodiment, the cross-track force mechanism 320 pushes the jetting module 200 to the right so that the alignment datum 215 on the inner face of the second alignment tab 205 contacts the right face of the notch 223, which serves as the corresponding cross-track alignment feature associated with the beam 222.

In other embodiments, other features on the jetting module 200 can serve as the alignment datum 215. For example, the alignment datum 215 can be on outer face of the first alignment tab 204. As the cross-track force mechanism 320 pushes the jetting module 200 to the right, the spacing between the alignment tabs 204, 205 and the spacing between the alignment tabs 244, 245 can be arranged such that the outer face of the first alignment tab 204 comes into contact with the inner face of the third alignment tab 244 (see FIG. 10) on the mounting assembly 240. In this case, the inner face of the alignment tab 244 serves as the corresponding cross-track alignment feature associated with the beam 222. Since the mounting assembly 240 is mounted onto the rail assembly 220 in a predefined location, with the cross-track alignment being defined relative to the beam 222 as has been discussed earlier, the cross-track alignment feature on the alignment tab 244 is therefore indirectly associated with the beam 222, even though it is not directly on the beam 222.

Figure 14:
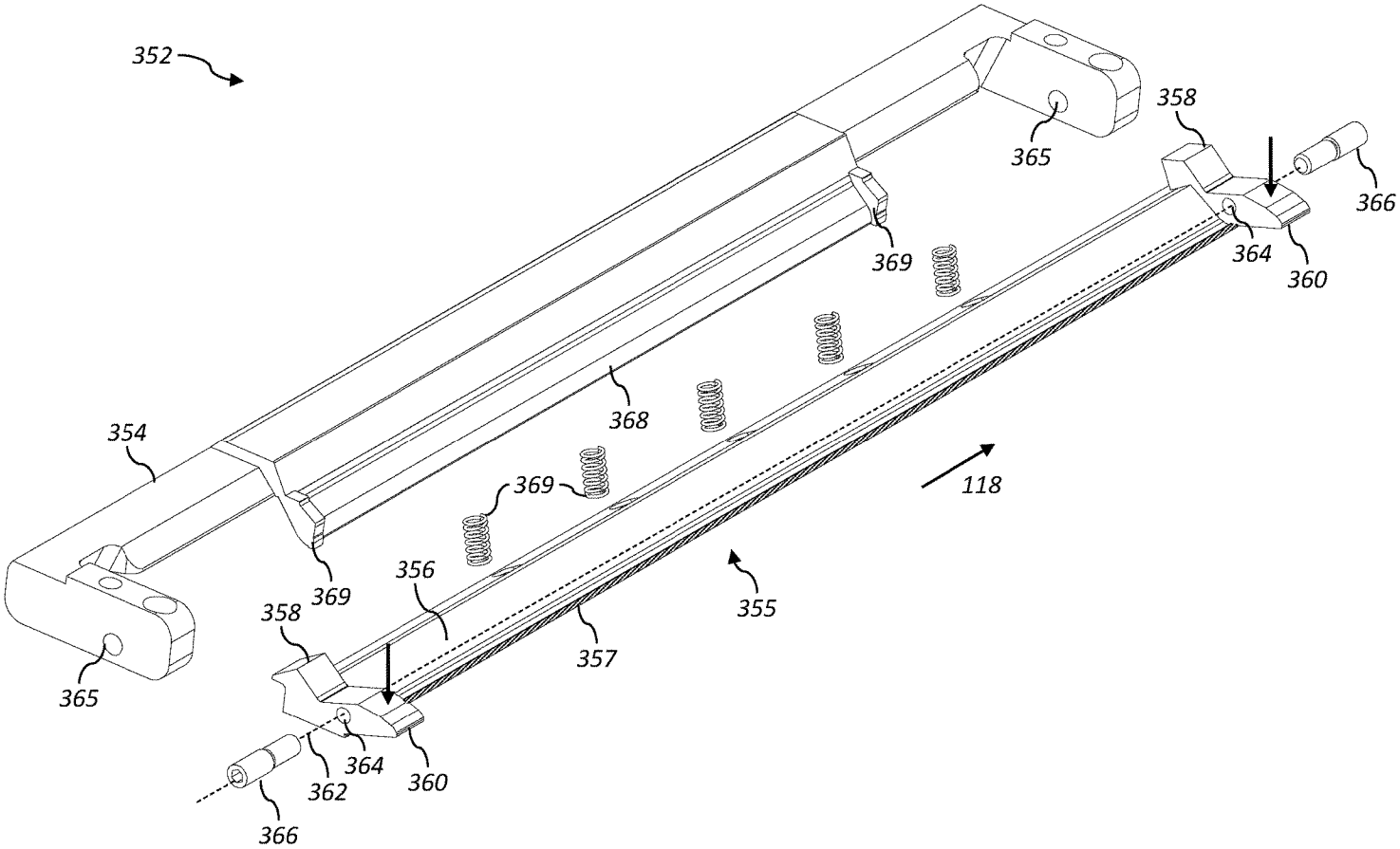
FIG. 14 is an exploded view showing components of a shutter mechanism including a repositionable shutter according to an exemplary embodiment.

FIG. 14 is an exploded view showing components of the shutter mechanism 352 according to an exemplary embodiment. The shutter mechanism 352 includes a shutter frame 354, and a repositionable shutter 355. In an exemplary configuration, the shutter frame 354 is adapted to be mounted to the mounting assembly 240 (see FIG. 10), and the repositionable shutter 355 is mounted to the shutter frame 354 using shafts 366 which enable the repositionable shutter 355 to pivot about a pivot axis 362. In other configurations, the shutter mechanism 352 can be mounted to other components of the printhead module 260 (e.g., the jetting module 200). Preferably, the shutter mechanism 352 is detachable from the printhead module 260 so that it can be removed for maintenance (e.g., cleaning) or replacement.

The repositionable shutter 355 includes a shutter blade 356 extending in the cross-track direction 118 from a first end to a second end. Tabs 358 are affixed to the first and second ends of the shutter blade 356. In the illustrated exemplary embodiment, both tabs 358 include lever arms 360, which are adapted to be pushed downward to rotate the repositionable shutter 355 around the pivot axis 362. When the repositionable shutter 355 is pivoted into a first pivot position, the shutter blade 356 blocks drops of ink from passing through the slot 350 (see FIG. 12B) and diverts the ink into the ink catcher 72. When the repositionable shutter 355 is pivoted into a second pivot position, the shutter blade 356 is moved away from the slot 350 so that drops of ink can pass through the slot 350. In a preferred configuration, the shutter blade 356 includes an elastomeric tip 357 adapted to seal against the lower plate 79 of the ink catcher 72 when the repositionable shutter 355 is in the first pivot position (see FIG. 16B).

In the illustrated exemplary configuration, the tabs 358 include circular holes 364 coaxial with the pivot axis 362. The shafts 366 are adapted to be mounted into holes 365 in the shutter frame 354 and extend into the holes 364 in the tabs 358 such that the shafts 366 and the holes 364, 365 are all coaxial with the pivot axis 362. In some configurations, the shafts 366 can be affixed to the shutter frame 354, so that the repositionable shutter 355 pivots around the shafts 366. In other configurations, the shafts 366 can be affixed to the repositionable shutter 355, so that the shafts 366 pivot together with the repositionable shutter 355. In the illustrated configuration, the holes 364 extend all the way through the tabs 358 and the holes 365 extend all the way through the tabs on the shutter frame 354. In other configurations, some or all of the holes 364, 365 may extend only partway through their respective tabs.

In the illustrated exemplary configuration, an air guide 368 is mounted to the shutter frame 354. When the shutter mechanism 352 is attached to the mounting assembly 240 (see FIG. 10), the air guide 368 is positioned to direct a stream of air from an air supply (not shown) downward through the slot 350 (see FIG. 12B). This is useful to keep the drops of ink from slowing down during their flight from the nozzle array 202 to the slot 350. In a preferred configuration, the air guide 368 defines one side wall of the slot 350, while the ink catcher 72 defines the other side wall (see FIG. 12B). In the illustrated configuration, the air guide 368 includes tabs 369 on both ends which define end walls for the slot 350.

Springs 369 are positioned between the shutter frame 354 and the shutter blade 356. The springs provide a restoring force that opposes the downward force on the lever arm 360 to pivot the repositionable shutter 355 back into the first pivot position with the downward force on the lever arm 360 is removed.

Figure 15:
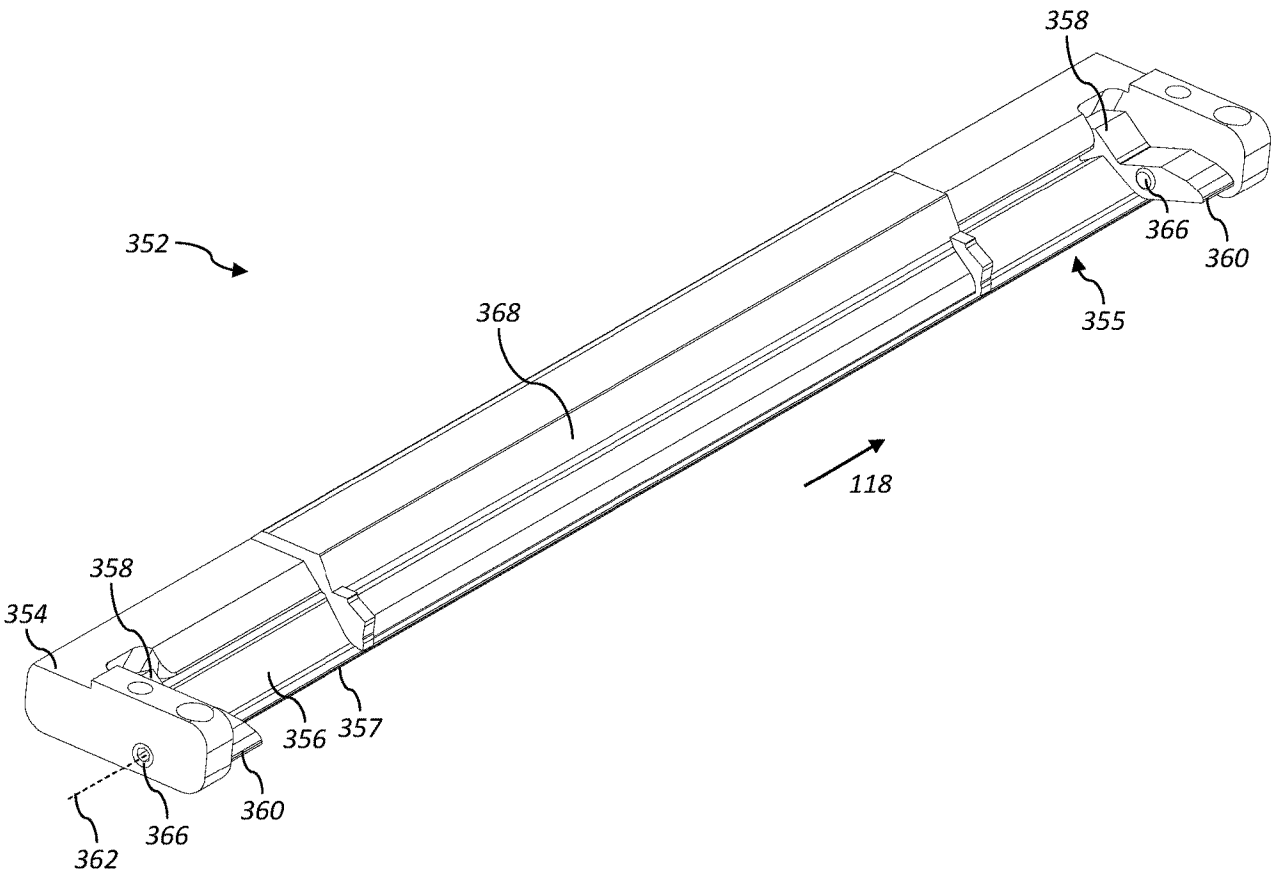
FIG. 15 shows the assembled components of the shutter mechanism of FIG. 14.

FIG. 15 shows the components of the shutter mechanism 352 of FIG. 14 in an assembled position. In this case, the repositionable shutter 355 is shown in the first pivot position where the shutter blade 356 is positioned to block the slot 350 (FIG. 12B).

Figure 16A:
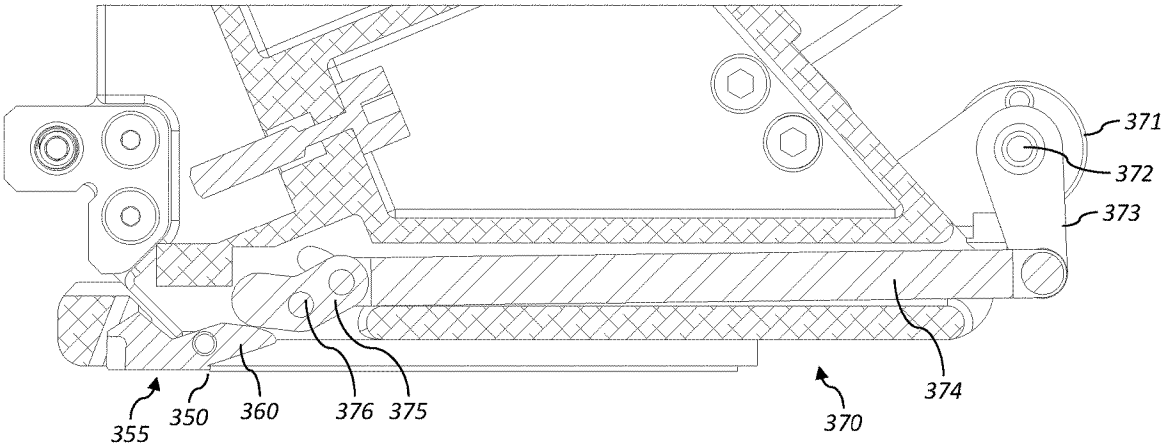
FIGS. 16A-16B illustrate the operation of the repositionable shutter of FIG. 15 using an actuator mechanism.
Figure 16B:
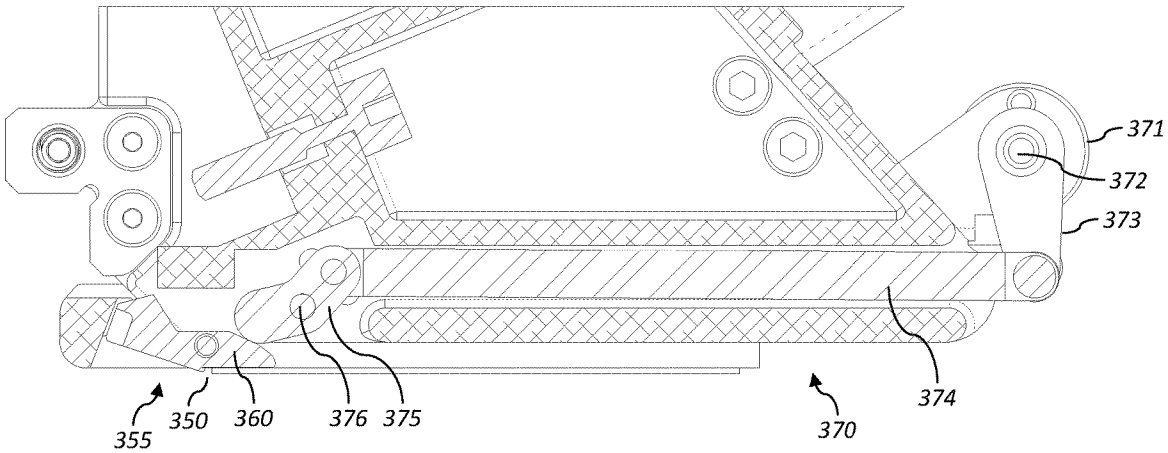

As discussed earlier, the shutter mechanism 352 is adapted to be operated by applying a force onto the lever arm 360 of the repositionable shutter 355. This can be accomplished with an actuator 370 as illustrated in FIGS. 16A-16B. In the illustrated exemplary configuration, the actuator 370 includes a motor 372 which rotates a lever 373 mounted onto a shaft 372 of the motor 372. The lever 371 can be rotated between a first position shown in FIG. 16A and a second position shown in FIG. 16B. The lever 371 is attached to a push rod 374. The push rod 374 is adapted to pivot a pivoting lever 375 around a pivot point 376. The pivoting lever 375 is adapted to apply a downward force onto the lever arm 360 of the repositionable shutter 355.

When the actuator 370 is in the first position shown in FIG. 16A, the pivoting lever 373 is moved away from the lever arm 360 of the repositionable shutter 355. The springs 360 of the shutter mechanism 352 pivot the repositionable shutter 355 into the first pivot position which blocks the slot 350.

When the actuator 370 is in the second position shown in FIG. 16B, the pivoting lever 373 is pushed downward onto the lever arm 360 of the repositionable shutter 355. This pivots the repositionable shutter 355 into the second pivot position which opens the slot 350.

In a preferred configuration, when power is applied to the actuator 370 (e.g., to the motor 371), the repositionable shutter 355 is pivoted from the closed first pivot position to the open pivot position, and when the power is turned off the repositionable shutter 355 returns to the closed first pivot position. This has the advantage that if the printer system 20 (FIG. 1) experiences a power failure, the repositionable shutter 355 will close providing a failsafe feature which prevents ink from flowing through the slot 350 onto the print medium 32.

As was discussed relative to FIG. 14, in some embodiments the repositionable shutter 355 includes lever arms 360 on both ends of the shutter blade 356. In this case, the actuator 370 can be configured to simultaneously apply a downward force to both lever arms 360. In an exemplary configuration, the motor 371 is positioned at a cross-track position intermediate to the two ends of the shutter blade as shown in FIG. 10. A rod 377 extends from the lever 373 to push rods 374 (FIG. 16A) located along both edges of the mounting assembly 240. The push rods 374 each connect to respective pivoting levers 375, which activate respective lever arms 360 of the shutter blade 356. In an alternate configuration (not shown) two separate actuators 370 are used to actuate the two lever arms 360. In other configurations, a single actuator 370 can be used to actuate a single lever arm 360 on one end of the shutter blade 356. However, this requires that the shutter blade 356 have sufficient stiffness so that it will not twist significantly during actuation.

Figure 17A:
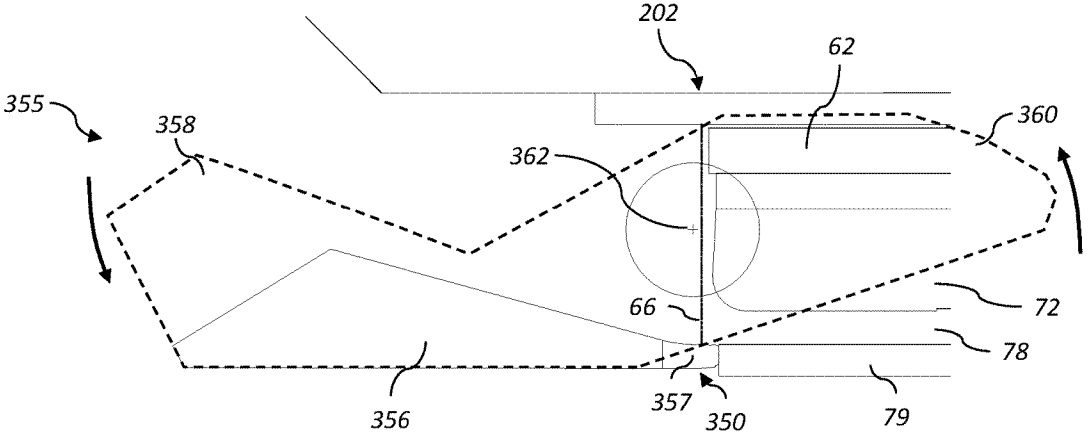
FIG. 17A-17B illustrate additional details pertaining to the operation of the repositionable shutter of FIG. 15.
Figure 17B:
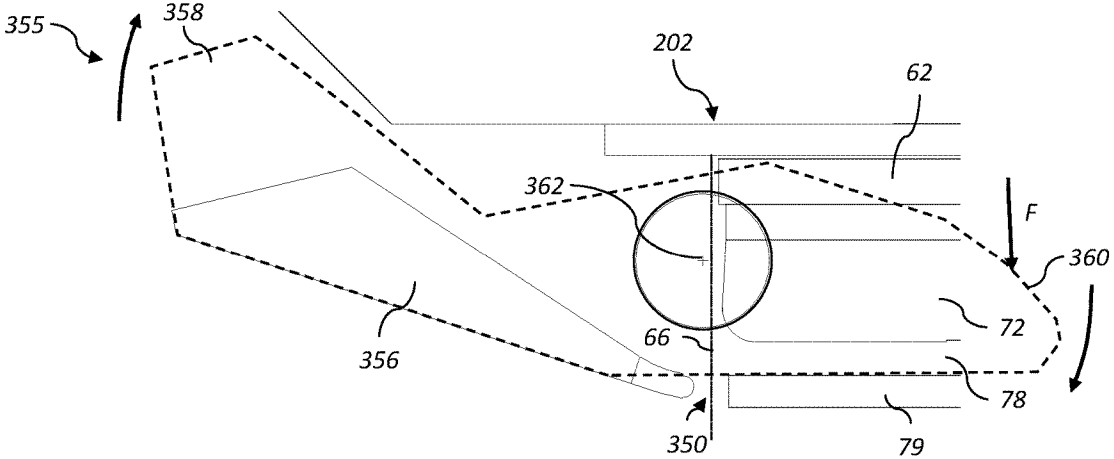

FIGS. 17A-17B illustrate additional details about the operation of the repositionable shutter 355. In FIG. 17A, the repositionable shutter 355 is pivoted into the first pivot position where the shutter blade 356 blocks the slot 350. In this position, the elastomeric tip 357 of the shutter blade 356 seals against the lower plate 79 of the ink catcher 72. This redirects any printing drops 66 into the liquid channel 78 of the ink catcher.

In FIG. 17B, a force F is applied onto the lever arm 360 of the tab 358 by the actuator 370 (see FIG. 16A). This causes the repositionable shutter 355 to pivot around the pivot axis 362, pivoting the repositionable shutter 355 into the second pivot position where the shutter blade 356 is pulled back from the slot 350, allowing printing drops 66 to reach the print medium 32.

The pivot axis 362 is preferably positioned between the nozzle array 202 and the slot 350. This enables the shutter blade 356 to be efficiently pulled back from the slot 350 with a relatively small angular rotation of the repositionable shutter 355. It also enables the shutter mechanism 352 to be compact, thereby enabling the distance between the nozzle array 202 and the rail assembly 220 to be reduced in order to minimize the nozzle array spacing 138 (see FIG. 12A).

The invention has been described in detail with particular reference to certain preferred embodiments thereof, but it will be understood that variations and modifications can be effected within the spirit and scope of the invention.

PARTS LIST

20 printer system
22 image source
24 image processing unit
26 control circuits
27 synchronization device
28 drop forming transducer
30 printhead
32 print medium
34 print medium transport system
35 speed measurement device
36 media transport controller
38 micro-controller
40 ink reservoir
44 ink recycling unit
46 ink pressure regulator
47 ink channel
48 jetting module
49 nozzle plate
50 nozzle
51 heater
52 liquid stream
54 drop
55 drop formation waveform source
57 trajectory
59 breakoff location
60 drop formation waveform
61 charging device
62 charging electrode
62' charging electrode
63 charging electrode waveform source
64 charging electrode waveform
66 printing drop
68 non-printing drop
69 drop selection system
70 deflection mechanism
71 deflection electrode
72 ink catcher
74 catcher face
76 ink film
78 liquid channel
79 lower plate
80 charging electrode waveform 64 period
82 first voltage state
84 second voltage state
86 non-print trajectory
88 print dot
92 drop formation waveform
94 drop formation waveform
96 period
98 pulse
100 period
102 pulse
104 large drop
106 small drop
108 phase shift
112 printhead assembly
116 in-track direction
118 cross-track direction
132 printing region
134 overlap region
136 centerline
138 nozzle array spacing
190 printhead assembly
200 jetting module
201 fillet
202 nozzle array
203 endmill
204 alignment tab
205 alignment tab
206 notch
207 face
208 face
209 protrusion
210 alignment datum
211 alignment datum
212 alignment datum
213 alignment datum
214 alignment datum
215 alignment datum
216 fluid connections
217 electrical connections
220 rail assembly
222 beam
223 notch
224 rod
225 rotational alignment feature
226 downstream side
228 upstream side
229 mounting bracket
240 mounting assembly
242 frame
244 alignment tab
245 alignment tab
250 alignment datum
251 alignment datum
252 alignment datum
253 alignment datum
254 alignment datum
255 alignment datum
256 rotational alignment feature

260 printhead module
300 jetting module clamping mechanism
302 handle
304 spring plunger
310 mounting assembly clamping mechanism
312 bolt
314 bolt hole
316 threaded hole
318 threaded hole
320 cross-track force mechanism
350 slot
352 shutter mechanism
354 shutter frame
355 repositionable shutter
356 shutter blade
357 elastomeric tip
358 tab
360 lever arm
362 pivot axis
364 hole
365 hole
366 shaft
369 spring
368 air guide
369 tab
370 actuator
371 motor
372 shaft
373 lever
374 push rod
375 pivoting lever
376 pivot point
377 bar
380 region
382 region

The invention claimed is:

1. An inkjet printhead assembly including a removable jetting module for printing on a print medium traveling along a media path from upstream to downstream, comprising:

a rail assembly spanning the print medium in the cross-track direction including:

a beam; and a rod attached to a side of the beam that faces the print medium;

a printhead module including:

a jetting module having an array of nozzles extending in a cross-track direction, wherein the jetting module includes:

a first alignment tab having a first alignment datum and a second alignment datum;

a second alignment tab having a third alignment datum and a fourth alignment datum, the second alignment tab being spaced apart from the first alignment tab in the cross-track direction;

a rotational alignment feature including a fifth alignment datum; and a cross-track alignment feature including a sixth alignment datum; and a mounting assembly adapted to engage with the rail assembly at a defined cross-track position including:

a third alignment tab having a seventh alignment datum and an eighth alignment datum;

a fourth alignment tab having a ninth alignment datum and a tenth alignment datum, the fourth alignment tab being spaced apart from the third alignment tab in the cross-track direction;

a rotational alignment feature including an eleventh alignment datum;

a jetting module clamping mechanism for applying a force to the jetting module that causes the first alignment datum, the second alignment datum, the third alignment datum and the fourth alignment datum of the jetting module to engage with the rod, and causes the fifth alignment datum of the jetting module to engage with corresponding rotational alignment feature associated with the beam; and a mounting assembly clamping mechanism for applying a force to the mounting assembly that causes the seventh alignment datum, the eighth alignment datum, the ninth alignment datum, and the tenth alignment datum of the mounting assembly to engage with the rod, and causes the eleventh alignment datum of the mounting assembly to engage with a corresponding alignment feature on the beam; and a jetting module cross-track force mechanism for applying a cross-track force to the jetting module that causes the sixth alignment datum of the jetting module to engage with a corresponding cross-track alignment feature associated with the beam;

wherein portions of the first and second alignment tabs of the jetting module and portions of the third and fourth alignment tabs of the mounting assembly are adapted to fit within corresponding notches in the beam.

2. The inkjet printhead assembly of claim 1, wherein the first and second alignment tabs include a notch having two faces, the first alignment datum and the second alignment datum corresponding to locations on the faces of the notch in the first alignment tab that contact the rod, and the third alignment datum and the fourth alignment datum corresponding to locations on the faces of the notch in the second alignment tab that contact the rod.

3. The inkjet printhead assembly of claim 2, wherein the notches are v-shaped.

4. The inkjet printhead assembly of claim 1, wherein the sixth alignment datum is a feature on the first alignment tab or the second alignment tab.

5. The inkjet printhead assembly of claim 4, wherein the sixth alignment datum is a side face of the first alignment tab or the second alignment tab, and wherein the cross-track alignment feature is a side face of the corresponding notch in the beam.

6. The inkjet printhead assembly of claim 1, wherein the jetting module cross-track force mechanism is a spring mechanism that applies the cross-track force to the jetting module.

7. The inkjet printhead assembly of claim 1, wherein the jetting module cross-track force mechanism is a component of the mounting assembly or is mounted on the mounting assembly.

8. The inkjet printhead assembly of claim 1, wherein the rotational alignment feature associated with the beam that engages with the fifth alignment datum of the jetting module is a feature of the mounting assembly having a predefined position relative to the beam.

9. The inkjet printhead assembly of claim 1, wherein the printhead module includes an ink catcher for catching non-printing drops of ink ejected from the array of nozzles, the ink catcher being mounted to the mounting assembly.

10. The inkjet printhead assembly of claim 9, wherein drops of ink ejected from the array of nozzles pass through a slot before they impinge on the print medium, and wherein the printhead module includes a repositionable shutter blade that can be positioned to block drops of ink from passing through the slot and divert the ink into the ink catcher, the repositionable shutter blade being mounted to the mounting assembly.

11. The modular inkjet printhead assembly of claim 9, wherein the ink catcher is positioned upstream of the array of nozzles for jetting modules engaging with the rail assembly on the upstream side of the rail assembly, and the ink catcher is positioned downstream of the array of nozzles for jetting modules engaging with the rail assembly on the downstream side of the rail assembly.

12. The inkjet printhead assembly of claim 1, wherein the printhead module includes a charging module for applying a charge to drops of ink ejected from the array of nozzles, the charging module being mounted to the mounting assembly.

13. The inkjet printhead assembly of claim 1, wherein the mounting assembly includes a mounting assembly cross-track alignment feature including a twelfth alignment datum, and further including a mounting assembly cross-track force mechanism for applying a cross-track force to the mounting assembly that causes the twelfth alignment datum to engage with a corresponding cross-track alignment feature associated with the beam thereby positioning the mounting assembly at the defined cross-track position.

14. The inkjet printhead assembly of claim 1, wherein the rod has a cylindrical shape around at least a portion of its circumference.

15. The inkjet printhead assembly of claim 1, wherein the jetting module clamping mechanism includes a spring loaded toggle clamp that can be operated by a human operator to apply the force to the associated jetting module.

16. The inkjet printhead assembly of claim 1, wherein the first tab is located in proximity to a first end of the jetting module, and the second tab is located in proximity to an opposing second end of the jetting module.

* * * * *